US009400438B2

(12) United States Patent
Fujii et al.

(10) Patent No.: US 9,400,438 B2
(45) **Date of Patent: *Jul. 26, 2016**

(54) ELECTROPHOTOGRAPHIC PHOTORECEPTOR, ELECTROPHOTOGRAPHIC PHOTORECEPTOR CARTRIDGE, AND IMAGE FORMING APPARATUS

(71) Applicant: Mitsubishi Chemical Corporation, Chiyoda-ku (JP)

(72) Inventors: Akiteru Fujii, Kanagawa (JP); Yuka Nagao, Kanagawa (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/452,852

(22) Filed: Aug. 6, 2014

(65) Prior Publication Data

US 2015/0050589 A1 Feb. 19, 2015

(30) Foreign Application Priority Data

Aug. 19, 2013 (JP) ..... 2013-169630

(51) Int. Cl.

| | |
|---|---|
| ***G03G 5/047*** | (2006.01) |
| ***G03G 5/06*** | (2006.01) |
| ***G03G 5/05*** | (2006.01) |
| ***G03G 5/147*** | (2006.01) |

(52) U.S. Cl.

CPC ..... *G03G 5/0614* (2013.01); *G03G 5/056* (2013.01); *G03G 5/0517* (2013.01); *G03G 5/0564* (2013.01); *G03G 5/14708* (2013.01)

(58) Field of Classification Search

USPC ..... 430/58.85, 58.75

See application file for complete search history.

(56) References Cited

U.S. PATENT DOCUMENTS

| | | | | |
|---|---|---|---|---|
| 5,665,500 | A | 9/1997 | Suzuki | |
| 5,733,697 | A | 3/1998 | Endoh et al. | |
| 2003/0190540 | A1 * | 10/2003 | Shoshi et al. | C07D 209/58 430/78 |
| 2010/0028791 | A1 | 2/2010 | Takaki et al. | |
| 2010/0330474 | A1 * | 12/2010 | Fujiwara et al. | G03G 5/056 430/56 |

FOREIGN PATENT DOCUMENTS

| | | | | |
|---|---|---|---|---|
| JP | 2940502 | | 8/1999 | |
| JP | 3556146 | | 8/2004 | |
| JP | 3939775 | | 7/2007 | |
| JP | 2008-070591 | * | 3/2008 | G03G 5/06 |
| JP | 2011-170041 | | 9/2011 | |
| JP | 4798494 | | 10/2011 | |
| JP | 2013-92760 | | 5/2013 | |

OTHER PUBLICATIONS

Translation of JP 2008-070591 published Mar. 2008.*
U.S. Appl. No. 14/608,839, filed Jan. 29, 2015, Fujii, et al.

* cited by examiner

*Primary Examiner* — Peter Vajda
(74) *Attorney, Agent, or Firm* — Oblon, McClelland, Maier & Neustadt, L.L.P.

(57) ABSTRACT

The present invention relates to an electrophotographic photoreceptor comprising a conductive support and at least a photosensitive layer provided thereon, wherein the electrophotographic photoreceptor comprises an outermost layer which contains a specific charge transport substance and a specific compound.

8 Claims, 2 Drawing Sheets

ELECTROPHOTOGRAPHIC PHOTORECEPTOR, ELECTROPHOTOGRAPHIC PHOTORECEPTOR CARTRIDGE, AND IMAGE FORMING APPARATUS

FIELD OF INVENTION

The present invention relates to an electrophotographic photoreceptor having excellent electrical properties and mechanical properties, an electrophotographic photoreceptor cartridge produced using the electrophotographic photoreceptor, and an image forming apparatus.

BACKGROUND OF INVENTION

Electrophotography is in extensive use in copiers, printers, and printing machines because of advantages thereof including the ability to instantaneously give high-quality images. With respect to the electrophotographic photoreceptor (hereinafter sometimes referred to as "photoreceptor"), which is the nucleus of electrophotography, photoreceptors employing organic photoconductive substances are in extensive use because these photoconductive substances have advantages such as freedom from pollution, ease of film formation, and ease of production.

Image forming apparatus based on electrophotography are being required to attain higher image quality, higher speed, and higher durability year after year. Although processes conducted on the periphery of the photoreceptor, such as charging, exposure, development, and transfer, also are being individually improved in order to meet those requirements, the improvements are not always sufficient or, in many cases, are not adopted for reasons of cost. In such cases, improvements in receptors are necessary, but there is little room for improvement by photoreceptor design.

For example, in the case of using a toner which has a shape close to sphere, such as a chemical toner, cleaning is difficult and, hence, an often employed technique is to heighten the pressure for touching the cleaning blade to the photoreceptor. In this case, not only the degree of wear of the photoreceptor increases, but also problems are prone to arise, such as adhesion of a component of the toner to the photoreceptor surface (filming), the occurrence of scratches, and the chatter of the cleaning blade (noise). There are often cases where such problems are desired to be solved by improving not the development system or cleaning system but the composition of the photoreceptor. Meanwhile, if the problems can be mitigated by an improvement in photoreceptor composition, the development systems and cleaning systems according to conventional techniques can be used as such and, hence, this solution is advantageous also from the standpoint of cost.

With respect to compositional improvements in photoreceptors also, gas resistance and surface properties including surface hardness are being improved by various methods (patent documents 2 to 6). However, there are various limitations. For example, in the case where the electrical responsiveness of a photoreceptor is desired to be enhanced in order to meet the request for an increase in speed, a usual technique is to increase the proportion of the charge transport substance in the photosensitive layer to the binder resin. However, the resultant photosensitive layer is prone to wear and is unable to meet the request for higher durability. Meanwhile, replacement of the binder resin, which is a conventional polycarbonate resin, with a polyester resin having high durability makes it impossible to meet the request for higher responsiveness, because the polyester resin is inferior in electrical property.

Such combinations of inconsistent performances are often encountered when photoreceptor compositions are designed. Consequently, a key to development is how to conquer the problem and reconcile the required performances.

Under these circumstances, patent document 1 has proposed a charge transport substance having a large conjugated system. This charge transport substance exhibits a high charge mobility even when used in a small amount relative to the binder resin amount, and shows an exceedingly low residual potential. This charge transport substance hence has the possibility of reconciling electrical properties and wear resistance.

DOCUMENT LIST

Patent Documents

[Patent Document 1] Japanese Patent No. 2940502
[Patent Document 2] Japanese Patent No. 3556146
[Patent Document 3] Japanese Patent No. 4798494
[Patent Document 4] Japanese Patent No. 3939775
[Patent Document 5] JP-A-2011-170041
[Patent Document 6] JP-A-2013-92760

SUMMARY OF THE INVENTION

However, investigations made by the present inventors revealed that the charge transport substance described in patent document 1, when dissolved together with a binder resin and used to form a photosensitive layer, renders the surface hardness of the photosensitive layer unusually low. In the case of a photosensitive layer having a low surface hardness, adhesion of the silica or the like used as an external additive for toners to the surface is prone to occur from plastically deformed sites or from scratches, and the adhesion of a toner component which is called filming is prone to occur. Furthermore, this photosensitive layer is apt to make a noise when the cleaning blade is slidingly rubbed thereagainst. There also is a possibility that the cleaning blade might catch foreign substances to form scratches in the photosensitive layer or to result in cleaning failures in toner removal, thereby causing streaks in images. For avoiding such troubles, it is effective to heighten both the surface hardness and degree of plastic deformation of the outermost layer.

Possible measures in heightening the surface hardness of a photosensitive layer include to dispose a protective layer on the outermost layer, to harden the photosensitive layer, to add a filler or the like to the photosensitive layer, and to add a charge transport substance having a low molecular weight in a large amount.

However, the disposition of a protective layer on the outermost layer not only results in an increase in cost but also is disadvantageous from the standpoint of electrical properties. This measure hence is usable only in high-grade applications, and has low suitability for general use. The measure in which the photosensitive layer is hardened has problems in that the remaining unreacted groups of the curable resin serve as charge traps to impair the electrical properties and that the coating fluid has a short pot life. The measure in which a filler is added to the photosensitive layer also may cause a deterioration in electrical property and has a possibility that the surface irregularities might cause, rather than prevent, filming or a cleaning failure. The addition of a large amount of a charge transport substance having a low molecular weight has a drawback that the addition, although increasing the surface hardness, results in a decrease in the degree of elastic deformation and the resultant photosensitive layer is brittle and prone to wear.

Meanwhile, patent documents 2 to 4 disclose a technique in which a lowly polar compound having a low molecular weight is added to thereby reduce gas permeability and, as a result, improve gas resistance. However, these patent documents include no statement concerning surface properties, in particular, surface hardness. Patent document 5 discloses a technique in which a charge transport substance having a large conjugated system is used in combination with a lowly polar compound having a low molecular weight to set the surface hardness at a high value, thereby improving surface properties. This charge transport substance has an even larger conjugated system like the charge transport substance according to the present invention and is satisfactory in terms of electrical property. However, patent document 5 includes no suggestion about applicability of the charge transport substance, which renders the surface hardness of the photosensitive layer unusually low. Patent document 6 discloses a technique in which a charge transport substance having a large conjugated system and a charge transport substance having a small conjugated system are used in combination to thereby improve surface properties including surface hardness. This method, however, has had a problem in that since the amount of the charge transport substances to be used, relative to the amount of the binder resin, is too large, the photoreceptor has impaired wear resistance and is unsuitable for use in applications where a long life is necessary.

The present invention has been achieved in view of the techniques of the background art described above. A subject for the invention is to sufficiently improve wear resistance, non-filming properties, and cleanability, which are indispensable to long-life use, and to provide an electrophotographic photoreceptor which exhibits these satisfactory performances and shows a sufficiently low residual potential during exposure, without undergoing any adverse influence on the electrical properties.

The present inventors diligently made investigations. As a result, the inventors have found that incorporation of a charge transport substance and a compound which have specific structures into an outermost layer makes it possible to provide an electrophotographic photoreceptor that exhibits highly satisfactory performances with respect to wear resistance, non-filming properties, and cleanability, which are indispensable to long-life use, without undergoing any adverse influence of the incorporation on the electrical properties and that shows a sufficiently low residual potential during exposure. The invention has been thus completed.

Essential points of the invention reside in the following <1> to <8>.

<1> An electrophotographic photoreceptor comprising a conductive support and a photosensitive layer provided thereon, wherein the electrophotographic photoreceptor comprises an outermost layer which contains a charge transport substance represented by the following formula (1) and a compound represented by the following formula (5):

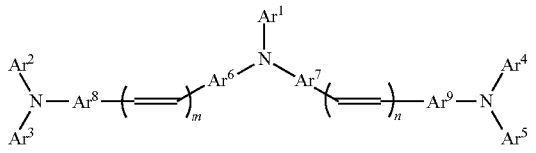

wherein $Ar^1$ to $Ar^5$ each independently represent an aryl group which may have a substituent, $Ar^6$ to $Ar^9$ each independently represent an arylene group which may have a substituent, and m and n each independently represent an integer of 1 to 3;

Formula (5)

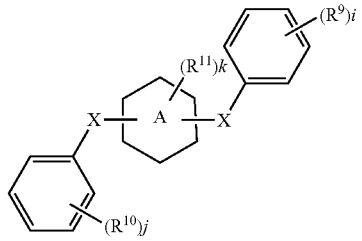

wherein $R^9$ to $R^{11}$ each independently represent an alkyl group, A represents a cyclohexane ring or benzene ring, X represents a single bond, —$CH_2$—, or —$CH_2OCO$—, and i to k each independently represent an integer of 0 to 3.

<2> The electrophotographic photoreceptor according to the item <1> above, wherein the photosensitive layer includes, as a binder resin, a polycarbonate resin which has a structural unit represented by the following formula (7):

Formula (7)

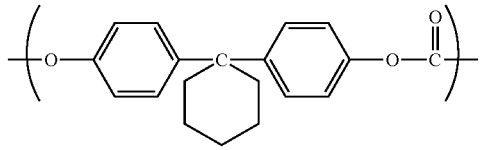

<3> The electrophotographic photoreceptor according to the item <1> above, wherein the photosensitive layer includes, as a binder resin, a polyester resin represented by the following formula (6):

Formula (6)

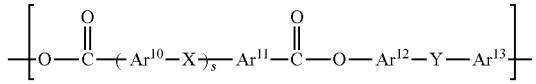

wherein $Ar^{10}$ to $Ar^{13}$ each independently represent an arylene group which may have a substituent, X represents a single bond, an oxygen atom, a sulfur atom, or an alkylene group, s represents an integer of 0 to 2, and Y represents a single bond, an oxygen atom, a sulfur atom, or an alkylene group.

<4> The electrophotographic photoreceptor according to any one of the items <1> to <3> above, wherein the outermost layer contains the compound represented by formula (5) in an amount of 1 to 20 parts by mass per 100 parts by mass of a binder resin of the outermost layer.

<5> The electrophotographic photoreceptor according to any one of the items <1> to <4> above, wherein the compound represented by formula (5) is any of compounds represented by the following formulae (2), (3), and (4):

Formula (2)

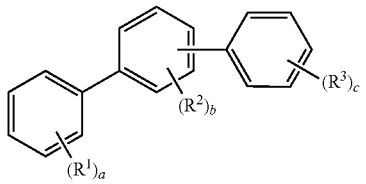

wherein $R^1$ to $R^3$ each independently represent an alkyl group, and a, b, and c each independently represent an integer of 0 to 3;

Formula (3)

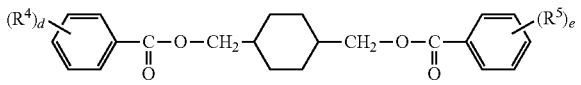

wherein $R^4$ and $R^5$ each independently represent an alkyl group, and d and e each independently represent an integer of 0 to 3;

Formula (4)

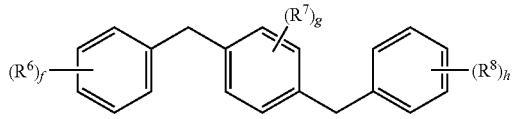

wherein $R^6$ to $R^8$ each independently represent an alkyl group, and f, g, and h each independently represent an integer of 0 to 3.

<6> The electrophotographic photoreceptor according to any one of the items <1> to <5> above, wherein in formula (1), $Ar^1$ to $Ar^5$ each independently represent a phenyl group which may have an alkyl group or alkoxy group, $Ar^6$ to $Ar^9$ each independently represent a 1,4-phenylene group which may have a substituent, and m and n are 1.

<7> An electrophotographic photoreceptor cartridge comprising: the electrophotographic photoreceptor according to any one of the items <1> to <6> above; and at least one selected from the group consisting of a charging device for charging the electrophotographic photoreceptor, an exposure device for exposing the charged electrophotographic photoreceptor to form an electrostatic latent image, and a developing device for developing the electrostatic latent image formed on the electrophotographic photoreceptor.

<8> An image forming apparatus comprising: the electrophotographic photoreceptor according to any one of the items <1> to <6> above; a charging device for charging the electrophotographic photoreceptor; an exposure device for exposing the charged electrophotographic photoreceptor to form an electrostatic latent image; and a developing device for developing the electrostatic latent image formed on the electrophotographic photoreceptor.

The present invention makes it possible to provide: an electrophotographic photoreceptor in which both a charge transport substance represented by formula (1) and a compound having a specific structure have been incorporated into the photosensitive layer and which, due to the incorporation thereof, has excellent wear resistance, shows high-speed responsiveness and a low residual potential, is excellent in terms of adhesion, non-filming property, and cleanability, and is suitable for use in long-life applications; an electrophotographic photoreceptor cartridge; and an image forming apparatus.

DETAILED DESCRIPTION OF THE INVENTION

Figure 1:
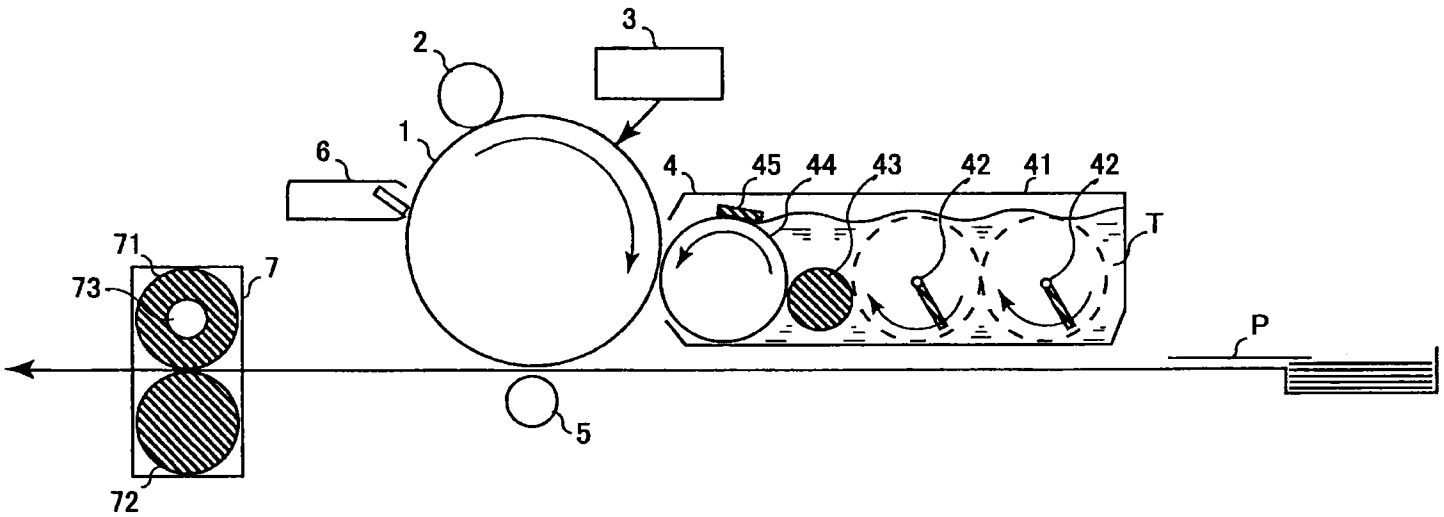
FIG. 1 is a diagrammatic view which illustrates the configuration of important portions of one embodiment of the image forming apparatus of the invention.

Embodiments of the invention will be explained below in detail. The following explanations on constituent elements of the invention are for representative embodiments of the invention, and the embodiments can be suitably modified unless the modifications depart from the spirit of the invention.

<Charge Transport Substance According to the Invention>

The charge transport substance according to the invention is represented by the following formula (1).

Formula (1)

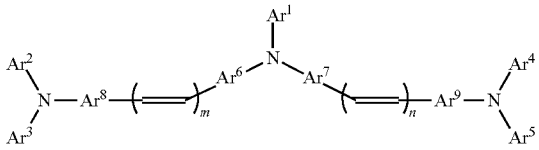

(In formula (1), $Ar^1$ to $Ar^5$ each independently represent an aryl group which may have a substituent, $Ar^6$ to $Ar^9$ each independently represent an arylene group which may have a substituent, and m and n each independently represent an integer of 1 to 3.)

In formula (1), $Ar^1$ to $Ar^5$ each independently represent an aryl group which may have a substituent. The number of carbon atoms of the aryl group is 30 or less, preferably 20 or less, more preferably 15 or less. Examples thereof include phenyl, naphthyl, biphenyl, anthryl, and phenanthryl. Preferred of these are phenyl, naphthyl, and anthryl, when the properties of the electrophotographic photoreceptor are taken into account. From the standpoint of charge-transporting ability, phenyl and naphthyl are more preferred, and phenyl is even more preferred. Examples of the substituents which may be possessed by $Ar^1$ to $Ar^5$ include alkyl groups, aryl groups, alkoxy groups, and halogen atoms. Specifically, examples of the alkyl groups include linear alkyl groups such as methyl, ethyl, n-propyl, and n-butyl, branched alkyl groups such as isopropyl and ethylhexyl, and cycloalkyl groups such as cyclohexyl. Examples of the aryl groups include phenyl and naphthyl which each may have a substituent. Examples of the alkoxy groups include linear alkoxy groups such as methoxy, ethoxy, n-propoxy, and n-butoxy, branched alkoxy groups such as isopropoxy and ethylhexyloxy, cyclic alkoxy groups such as cyclohexyloxy, and alkoxy groups having one or more fluorine atoms, such as trifluoromethoxy, pentafluoroethoxy, and 1,1,1-trifluoroethoxy. Examples of the halogen atoms include fluorine, chlorine, and bromine atoms. Preferred of these, from the standpoint of availability of starting materials, are alkyl groups having 1-20 carbon atoms and alkoxy groups having 1-20 carbon atoms. More preferred, from the standpoint of handleability during production, are alkyl groups having 1-12 carbon atoms and alkoxy groups having 1-12 carbon atoms. Even more preferred are alkyl groups having 1-6 carbon atoms and alkoxy groups having 1-6 carbon atoms, from the standpoint of the photodecay characteristics of the electrophotographic photoreceptor. In the case where $Ar^1$ to $Ar^5$ are phenyl, it is preferable, from the standpoint of charge-transporting ability, that each phenyl group should have one or more substituents. Although the number of substituents thereof can be 1-5, the number thereof is preferably 1-3 from the standpoint of availability of starting materials, and is more preferably 1-2 from the standpoint of the properties of the electrophotographic photoreceptor. In the case where $Ar^1$ to $Ar^5$ are naphthyl, it is preferable, from the standpoint of availability of starting materials, that the number of substituents thereof should be 2 or less or that each naphthyl group should have no substituent. It is more preferable that the number of substituents thereof should be 1 or that each naphthyl group should have no substituent. It is preferable that $Ar^1$ should have at least one substituent at any of the ortho and para positions to the nitrogen atom, and the substituent preferably is an alkoxy group having 1-6 carbon atoms or an alkyl group having 1-12 carbon atoms from the standpoint of solubility.

In formula (1), $Ar^6$ to $Ar^9$ each independently represent an arylene group which may have a substituent. The number of carbon atoms of the arylene group is 30 or less, preferably 20 or less, more preferably 15 or less. Examples thereof include phenylene, biphenylene, naphthylene, anthrylene, and phenanthrylene. When the properties of the electrophotographic photoreceptor are taken into account, phenylene and naphthylene are preferred of these, and phenylene is more preferred. Examples of the substituents which may be possessed by $Ar^6$ to $Ar^9$ include the same substituents as those enumerated above as examples of the substituents which may be possessed by $Ar^1$ to $Ar^5$. Preferred of these, from the standpoint of availability of starting materials, are alkyl groups having 1-6 carbon atoms and alkoxy groups having 1-6 carbon atoms. More preferred, from the standpoint of handleability during production, are alkyl groups having 1-4 carbon atoms and alkoxy groups having 1-4 carbon atoms. Even more preferred are methyl, ethyl, methoxy, and ethoxy, from the standpoint of the photodecay characteristics of the electrophotographic photoreceptor. In cases when $Ar^6$ to $Ar^9$ have substituents, there is a possibility that the molecular structure might be twisted to prevent intramolecular expansion of π-conjugation and to lower the electron-transporting ability. It is therefore preferable that $Ar^6$ to $Ar^9$ should have no substituent. From the standpoint of the properties of the electrophotographic photoreceptor, 1,3-phenylene, 1,4-phenylene, 1,4-naphthylene, 2,6-naphthylene, and 2,8-naphthylene are more preferred, and 1,4-phenylene is even more preferred.

Symbols m and n each independently represent an integer of 1 to 3. In case where m and n are too large, this charge transport substance tends to have reduced solubility in coating-fluid solvents. It is therefore preferable that m and n should be 2 or less. From the standpoint of the charge-transporting ability of the charge transport substance, it is more preferable that m and n be 1. In the case where m and n are 1, the moieties each represent an ethenyl group and the compound includes geometrical isomers; the trans structure is preferred from the standpoint of the properties of the electrophotographic photoreceptor. In the case where m and n are 2, the moieties each represent a butadienyl group and this compound also includes geometrical isomers. From the standpoint of the storability of the coating fluid, however, it is preferable that the charge transport substance should be a mixture of two or more geometrical isomers.

The electrophotographic photoreceptor of the invention may be one which includes an outermost layer that contains a compound represented by formula (1) as the only component represented by formula (1), or can be one which includes an outermost layer that contains compounds represented by formula (1) as a mixture thereof.

Especially preferred are compounds represented by the following formula (1a). Formula (1a) is formula (1) wherein $Ar^1$ is a phenyl group having an alkyl group, alkoxy group, aryloxy group, or aralkyloxy group, $Ar^2$ to $Ar^5$ are each independently a phenyl group which may have as a substituent an alkyl group having 1-6 carbon atoms, $Ar^6$ to $Ar^9$ are each an unsubstituted 1,4-phenylene group, and m and n are each 1.

Formula (1a)

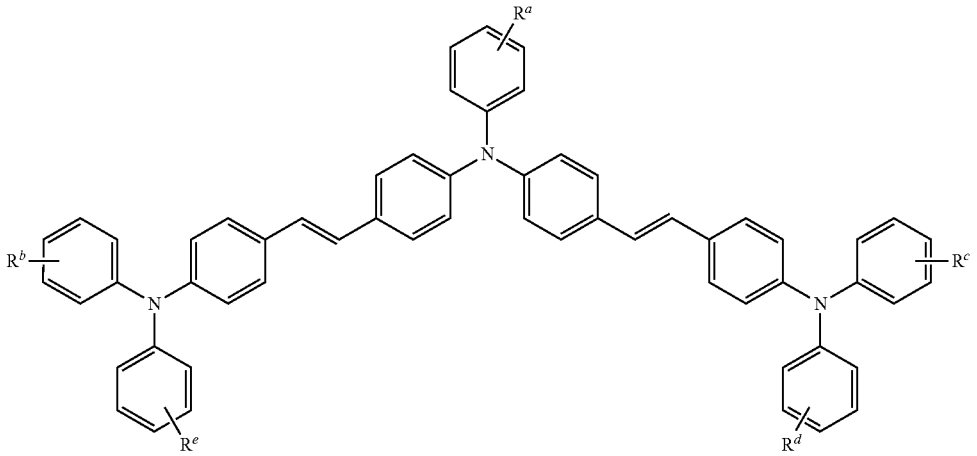

(In formula (1a), $R^a$ represents an alkyl group, an alkoxy group, an aryloxy group, or an aralkyloxy group, and $R^b$ to $R^e$ each independently represent either an alkyl group having 1-6 carbon atoms or a hydrogen atom.)

With respect to the proportion of the binder resin in the outermost layer to the compound represented by formula (1), the charge transport substance is used usually in an amount of 5 parts by mass or larger per 100 parts by mass of the binder resin in the same layer. In particular, the amount thereof is preferably 10 parts by mass or larger from the standpoint of lowering residual potential, and is more preferably 15 parts by mass or larger from the standpoints of stability in repeated use and of charge mobility. Meanwhile, from the standpoint of thermal stability, the charge transport substance is used usually in an amount of 120 parts by mass or less. In particular, the amount of the compound represented by formula (1) is preferably 100 parts by mass or less from the standpoint of compatibility between the compound and the binder resin, more preferably 90 parts by mass or less from the standpoint of heat resistance, even more preferably 80 parts by mass or less from the standpoint of scratch resistance, and especially preferably 50 parts by mass or less from the standpoint of wear resistance.

Examples of the structure of the charge transport substance which are suitable for the invention are shown below. The following structures are mere examples for more specifically explaining the invention, and the charge transport substance should not be construed as being limited to the following examples unless the examples depart from the spirit of the invention.

CT1

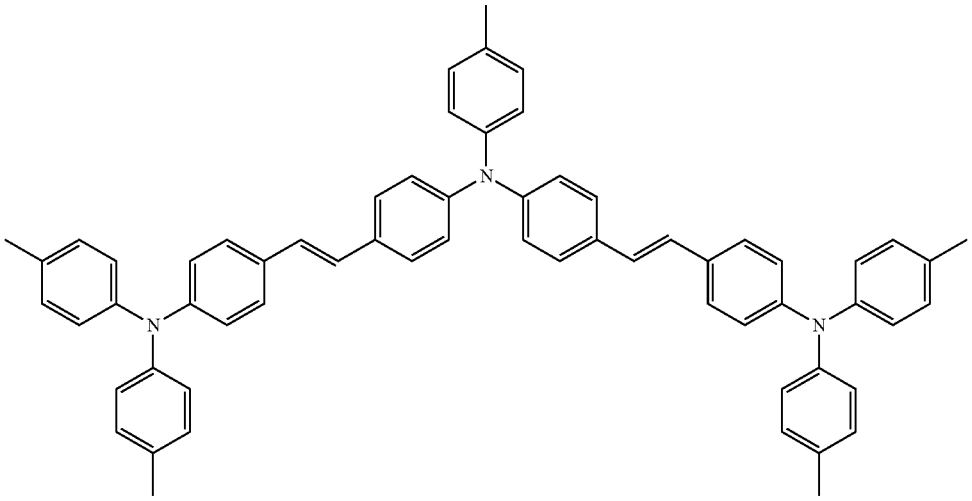

CT2

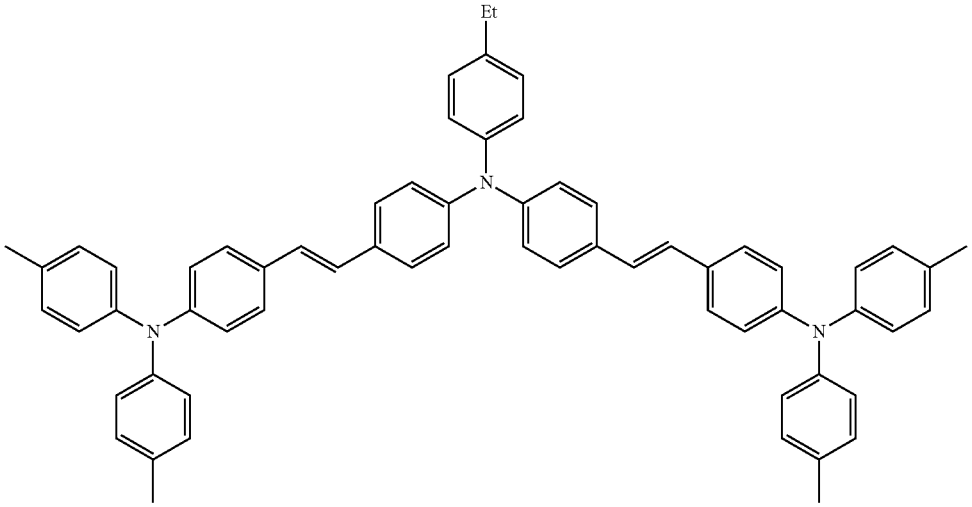

-continued
CT3
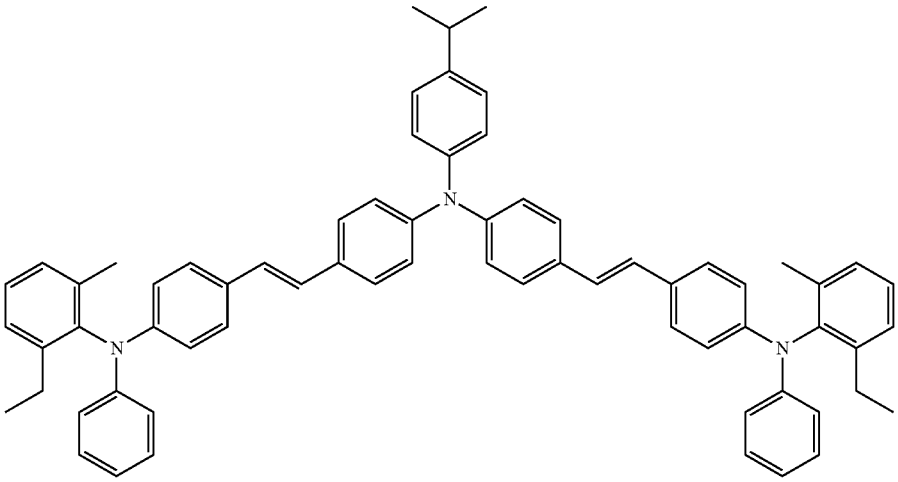
CT4
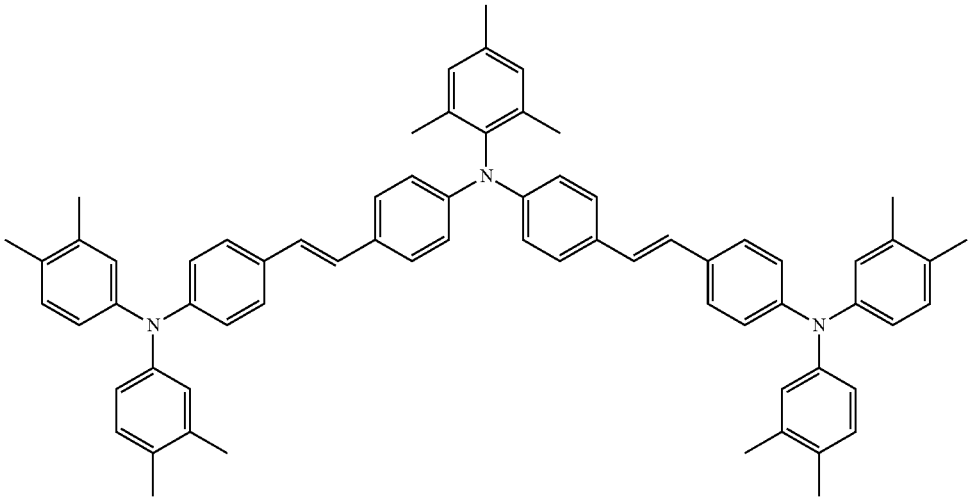
CT5
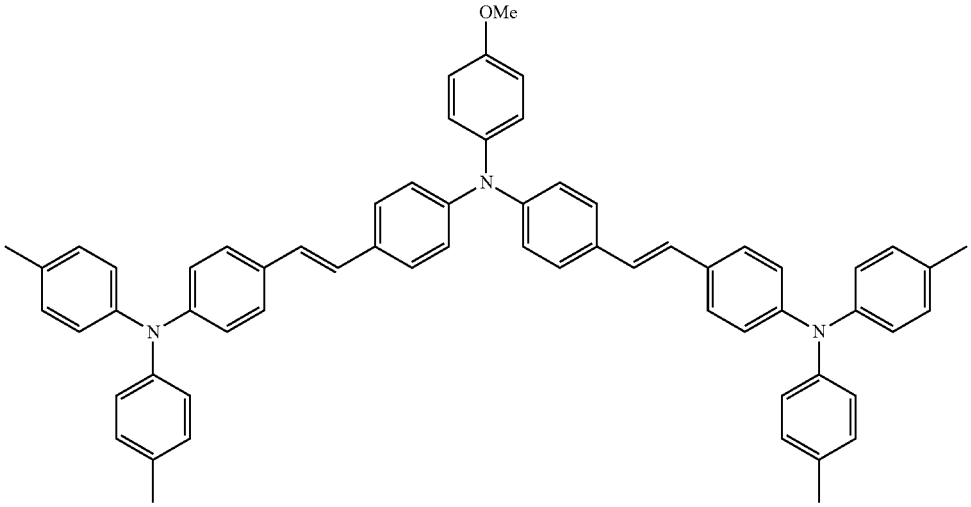

-continued
CT6
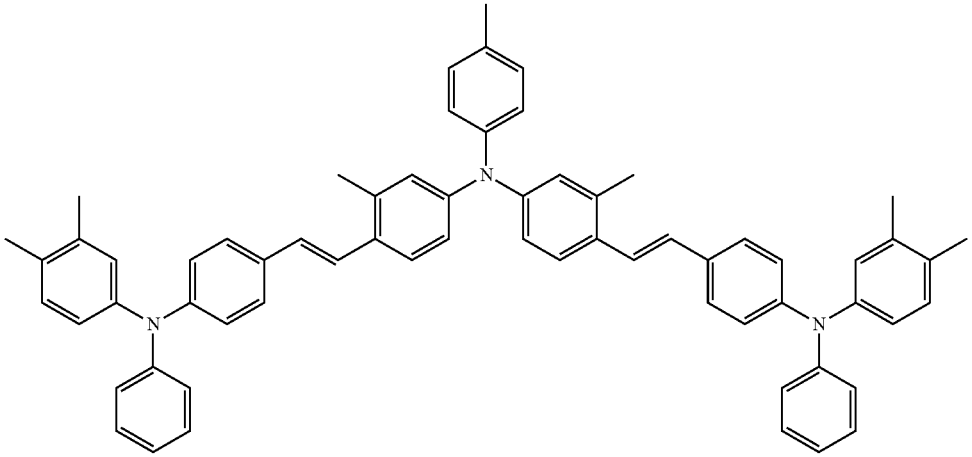
CT7
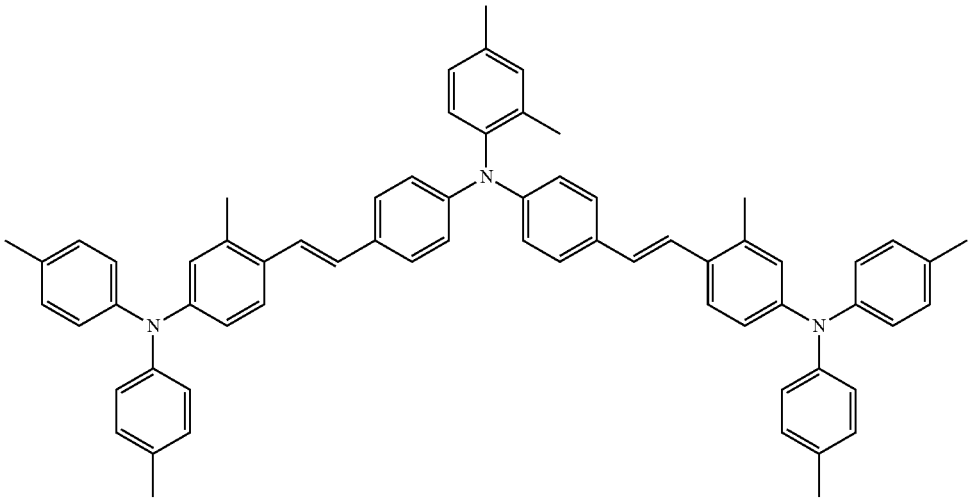
CT8
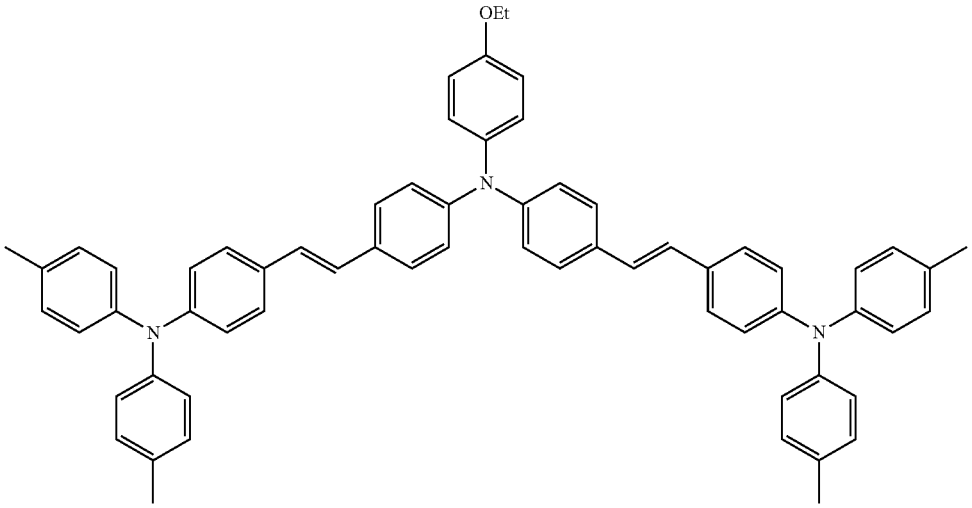

-continued
CT9
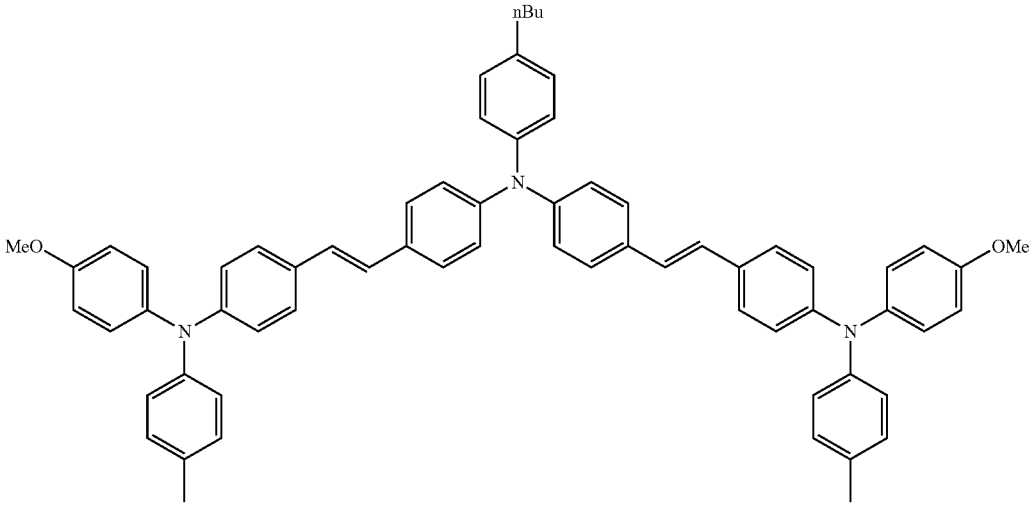
CT10
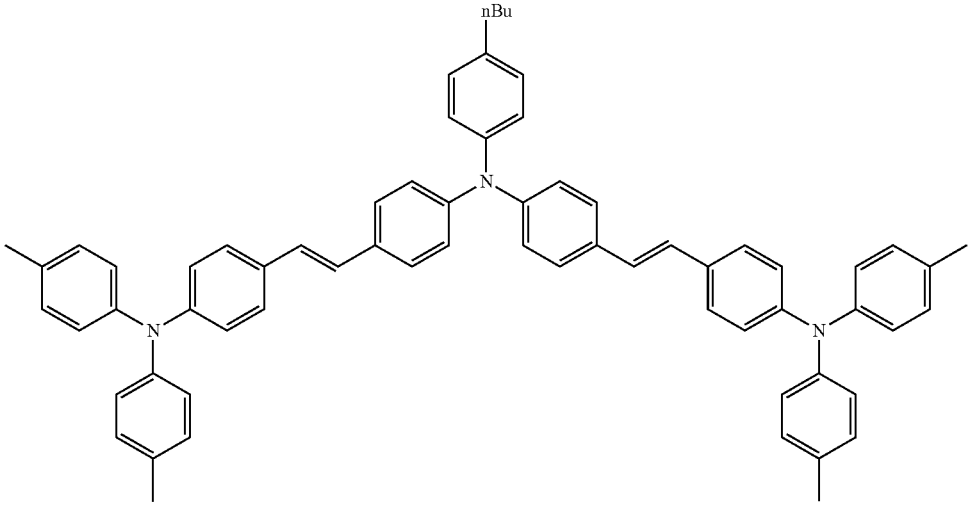
CT11
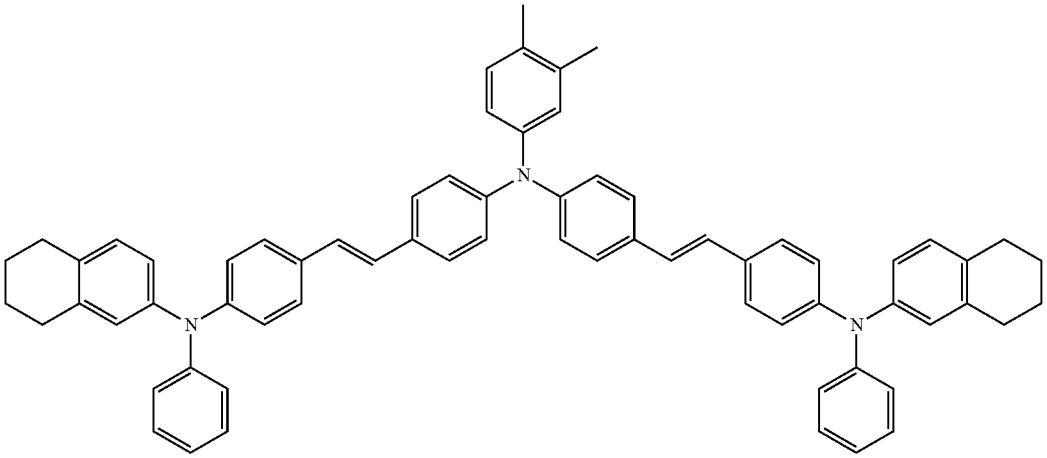

-continued
CT12
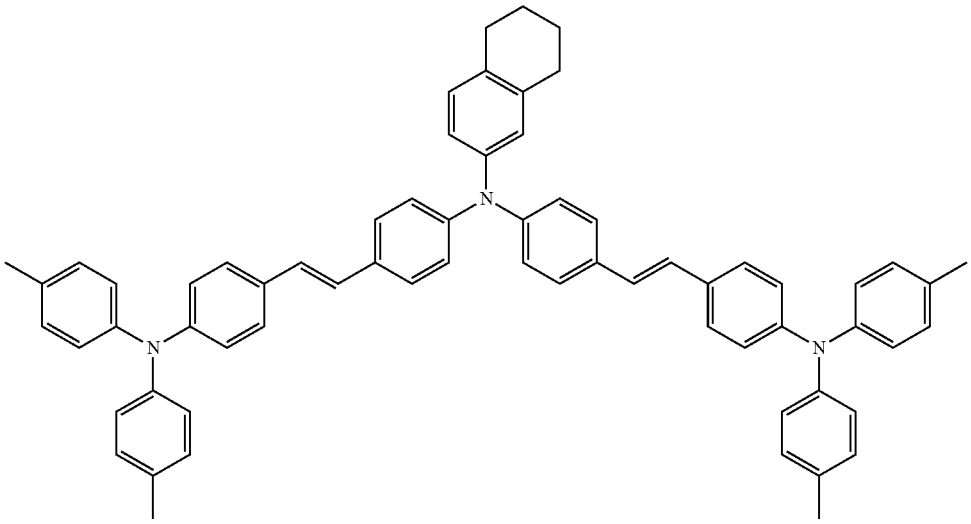
CT13
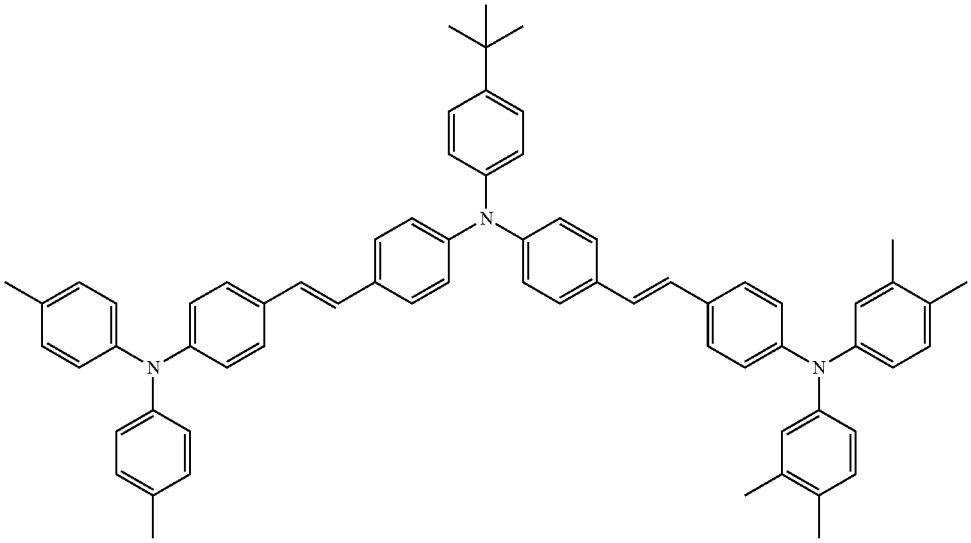
CT14
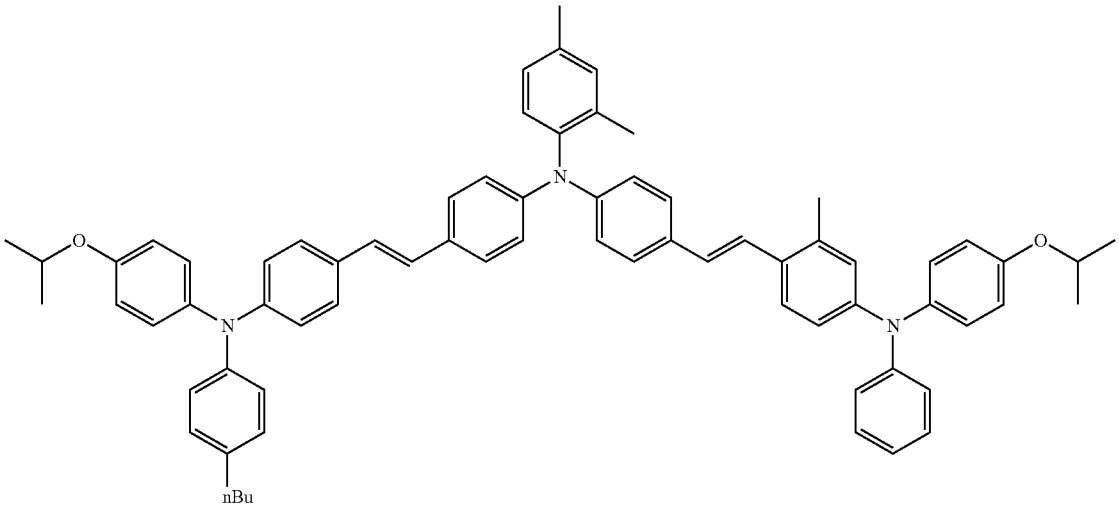

-continued
CT15
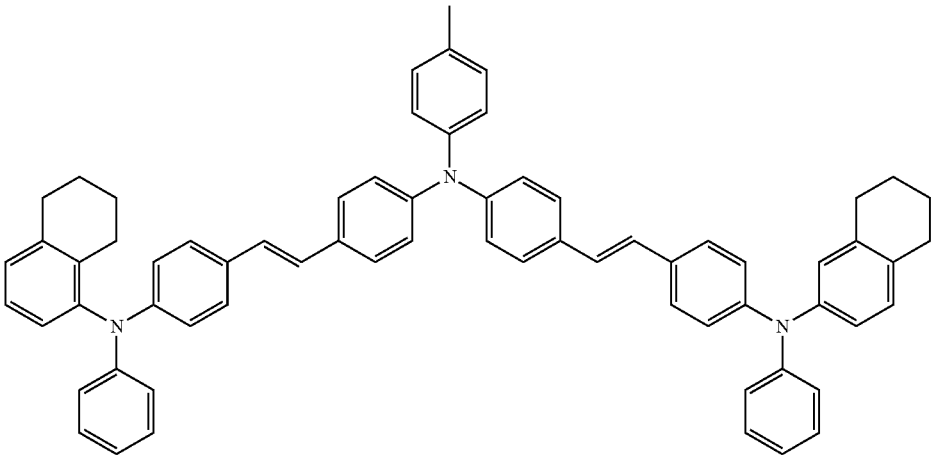
CT16
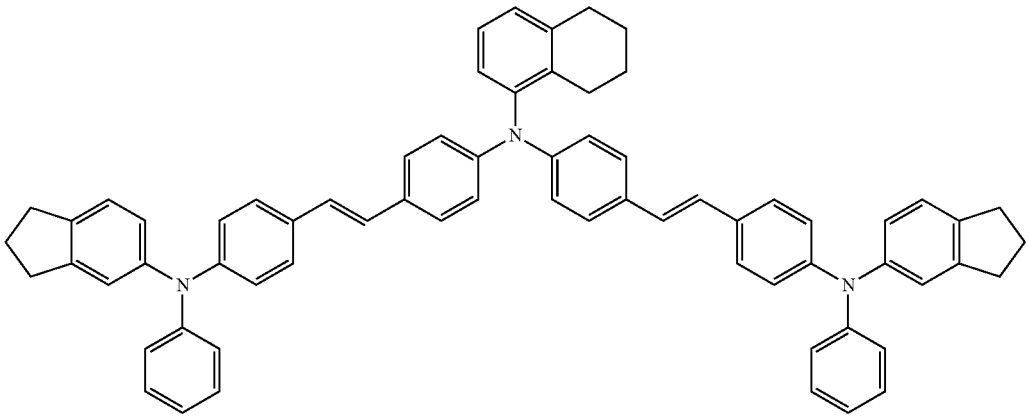
CT17
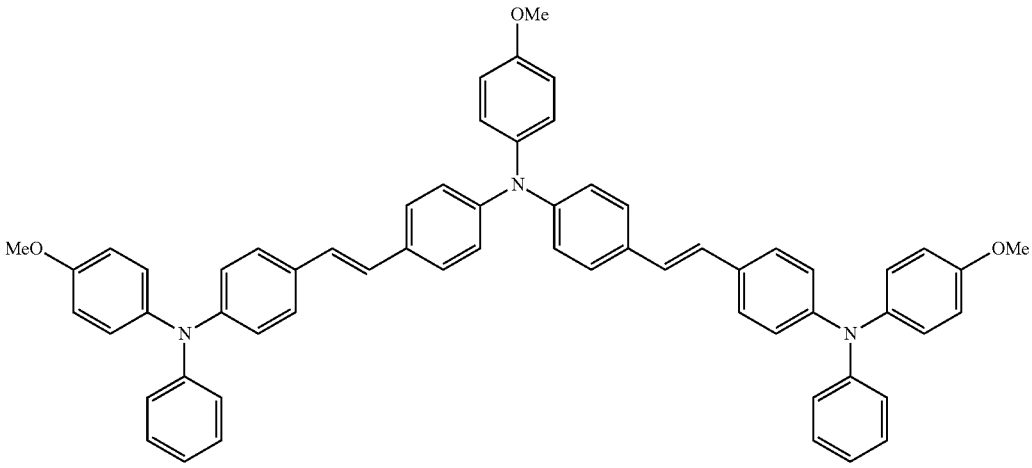

-continued
CT18
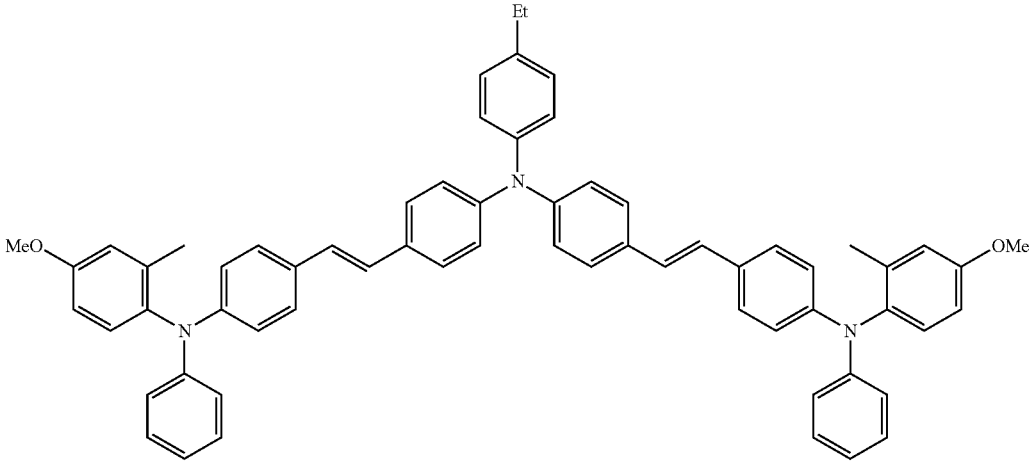
CT19
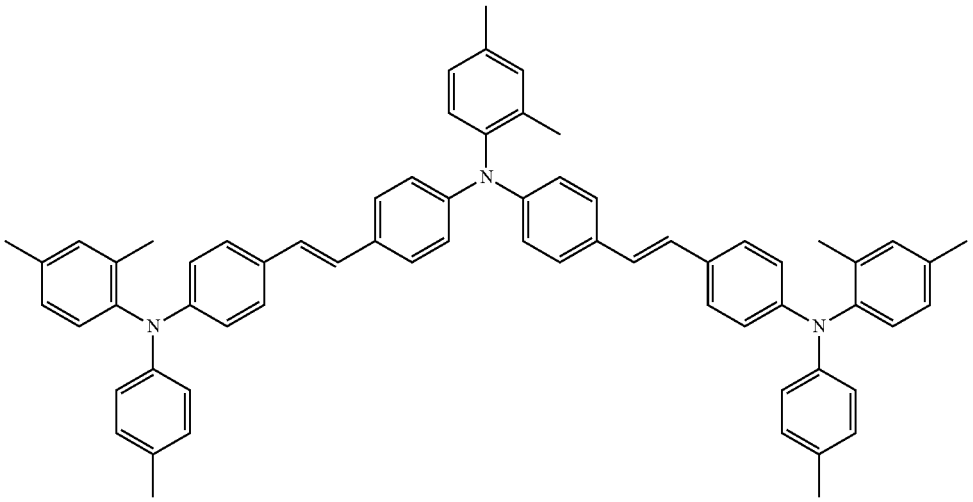
CT20
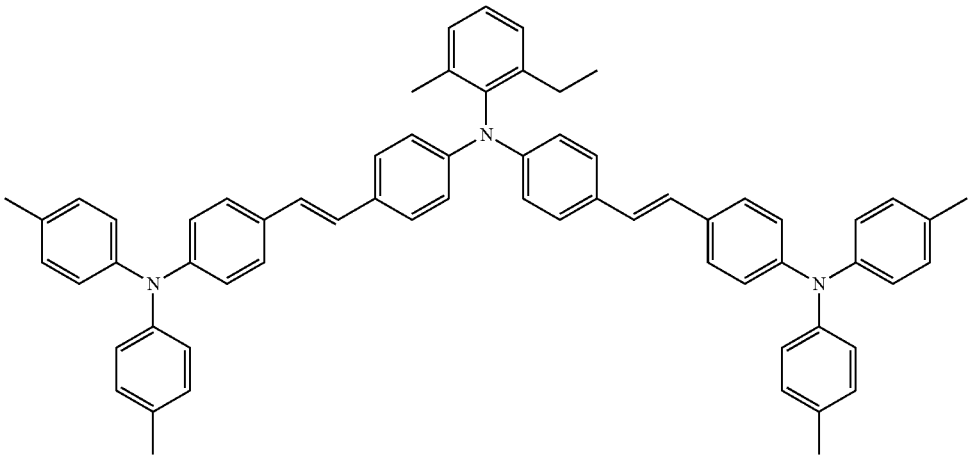

-continued
CT21
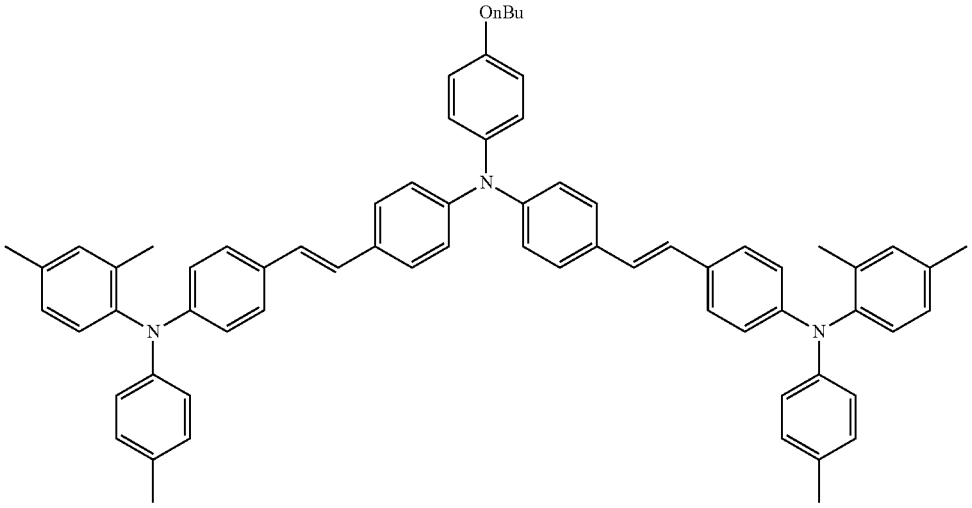
CT22
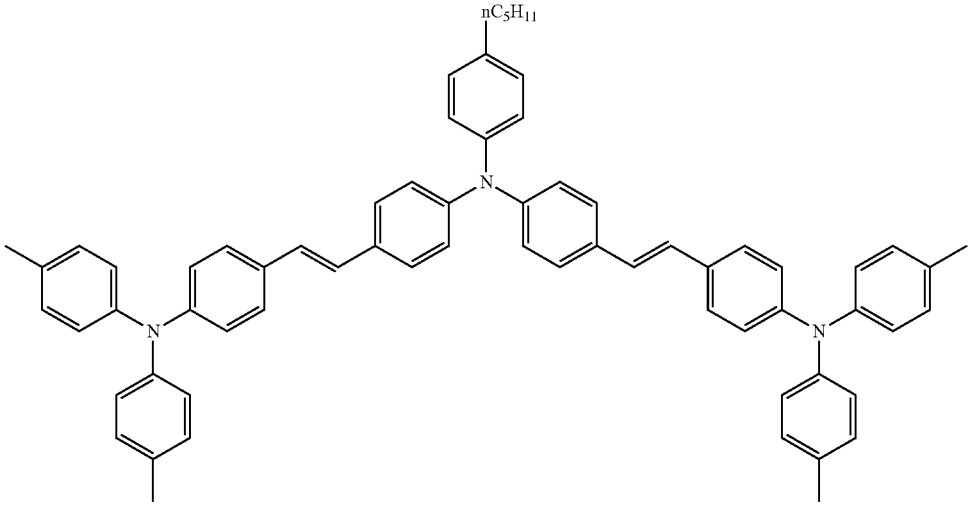
CT23
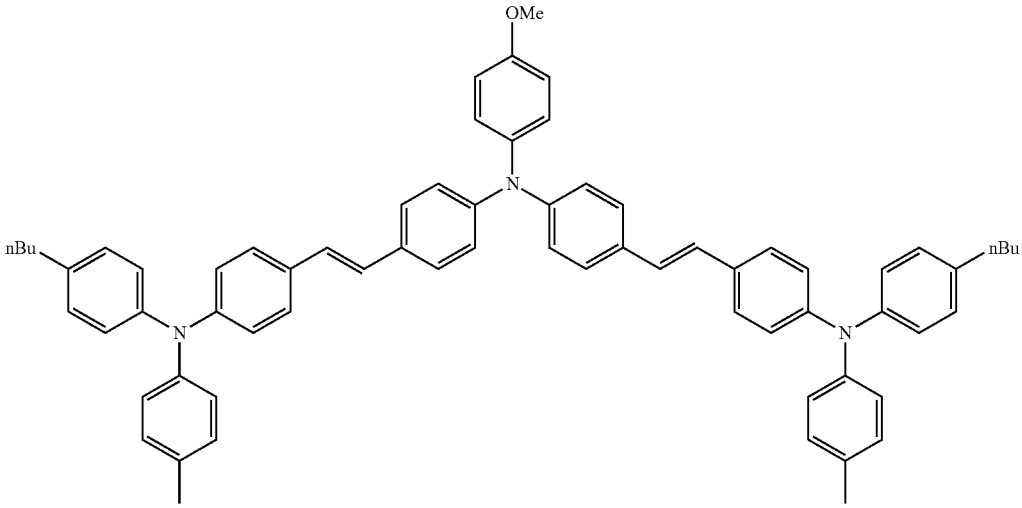

-continued
CT24
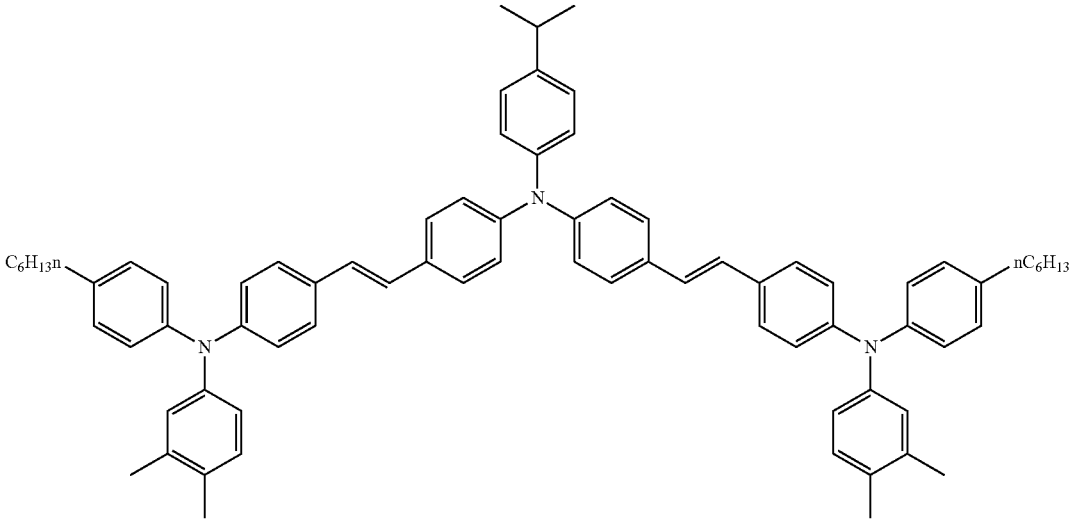
CT25
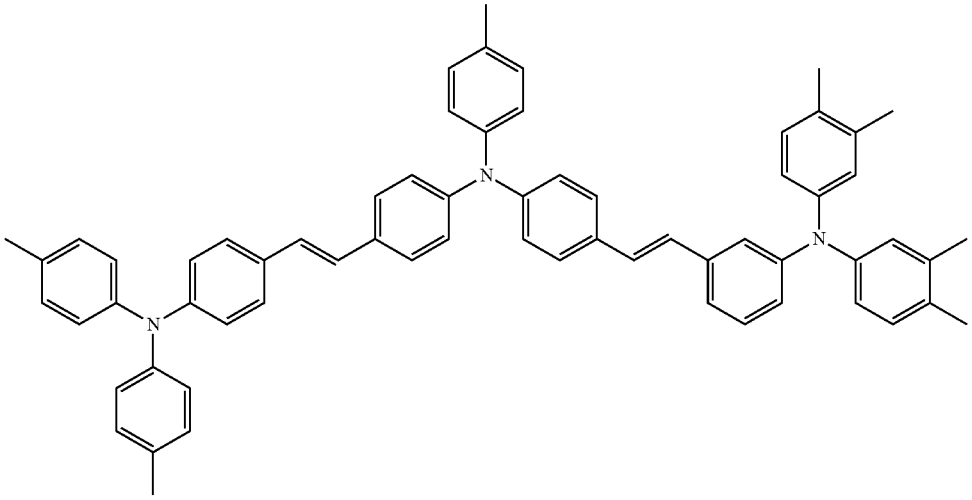
CT26
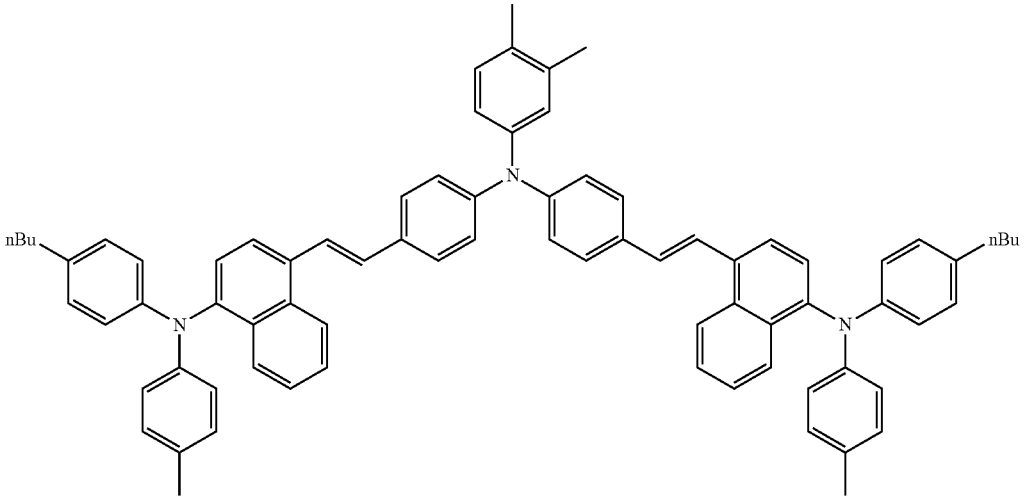

-continued
CT27
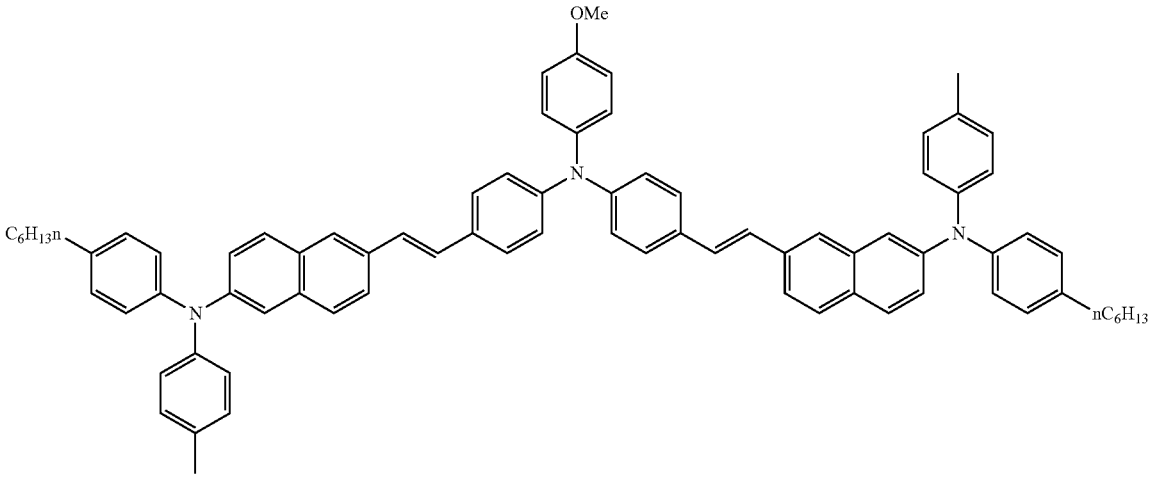
CT28
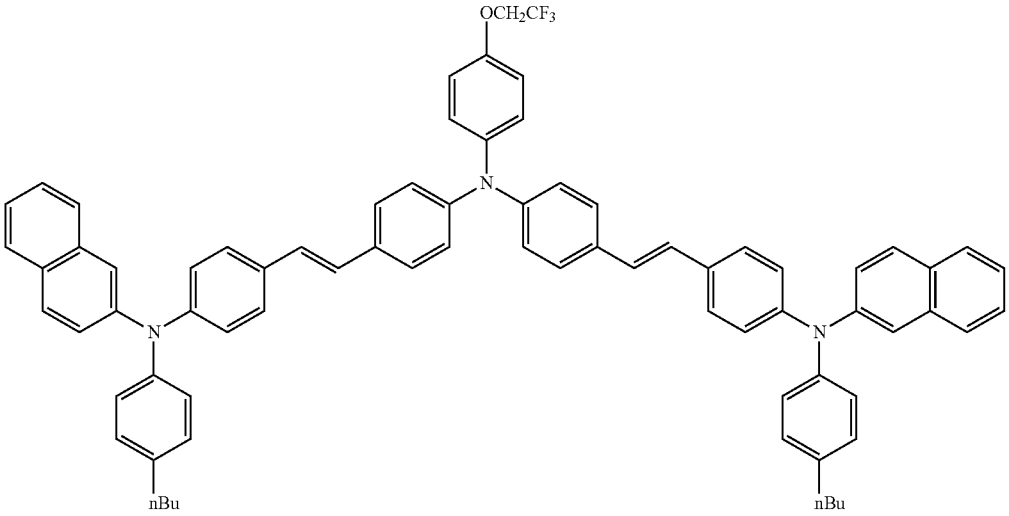
CT29
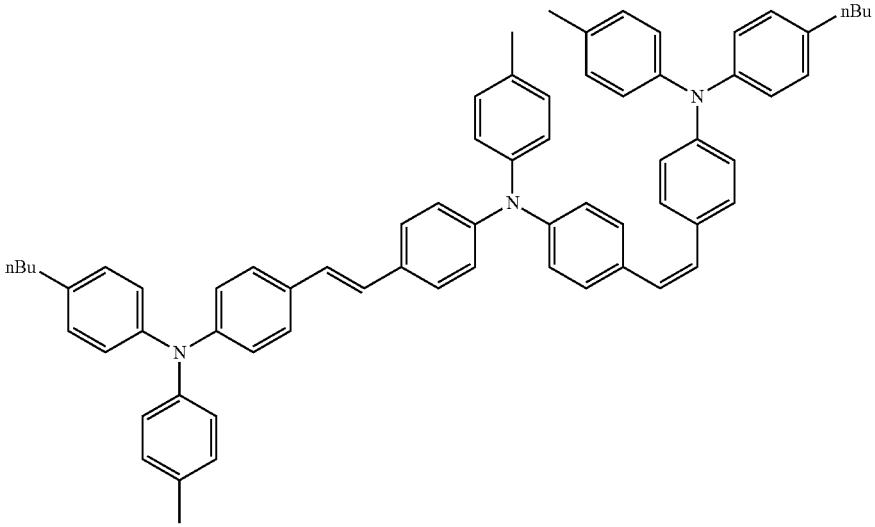

-continued
CT30
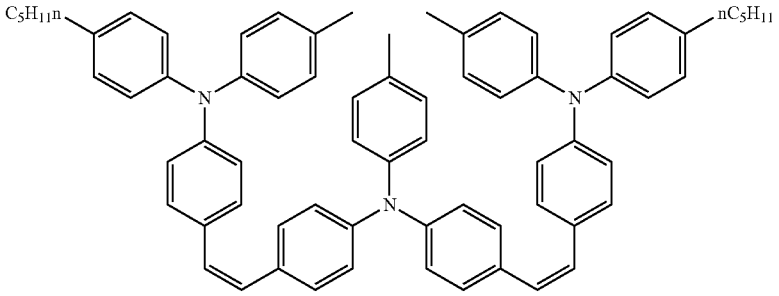
CT31
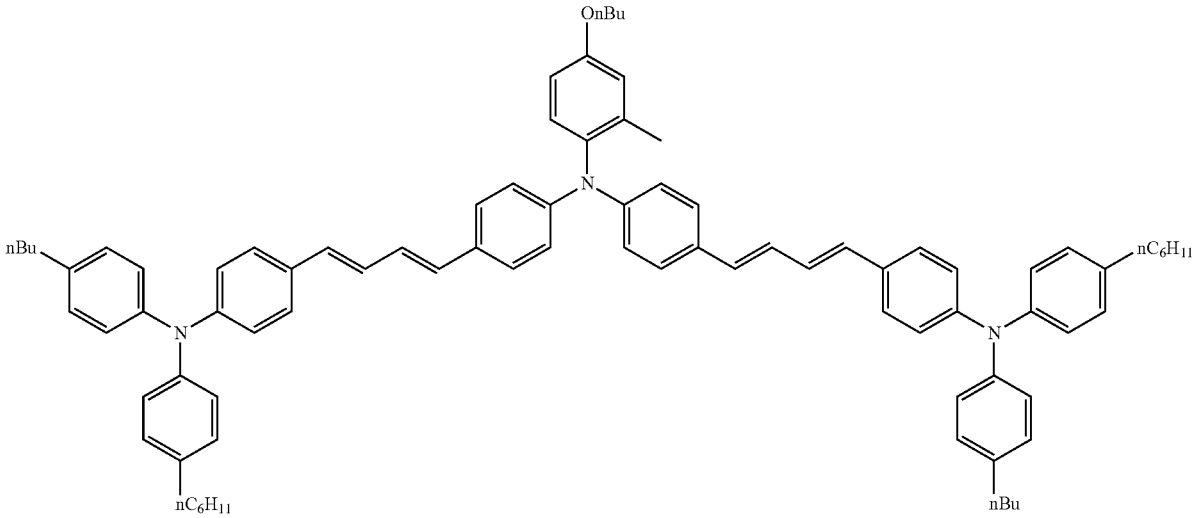
CT32
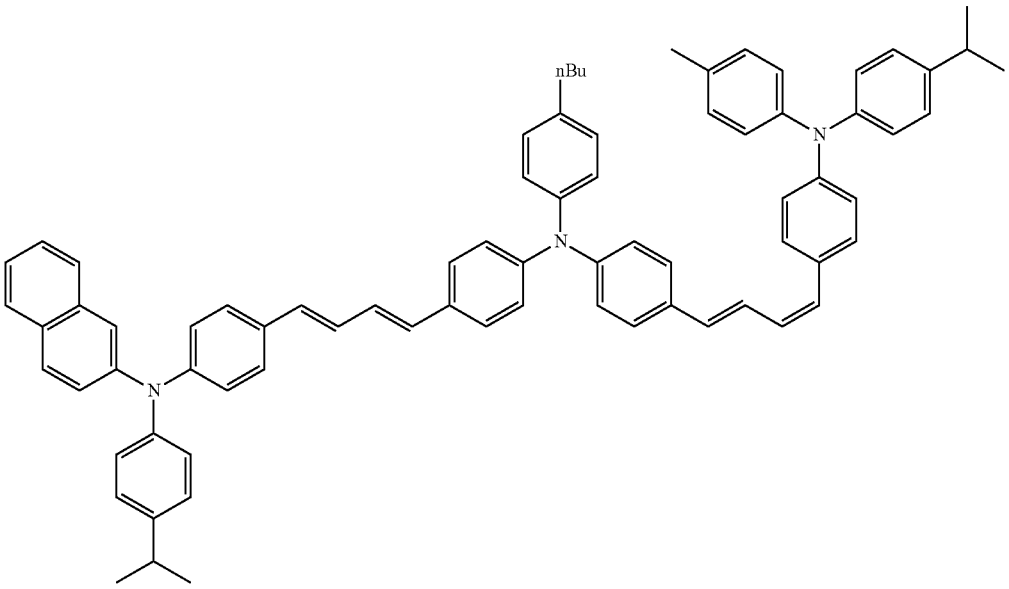

<Compound Represented by Formula (5)>

The outermost layer according to the invention contains a compound represented by the following formula (5), this compound and the charge transport substance represented by formula (1) being contained in the same layer.

Formula (5)

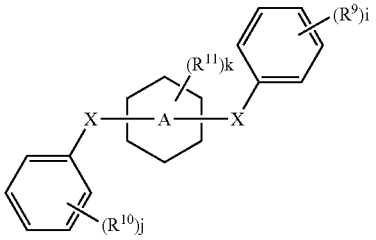

(In the formula (5), $R^9$ to $R^{11}$ each independently represent an alkyl group, A represents cyclohexane or benzene, X represents a single bond, —$CH_2$—, or —$CH_2OCO$—, and i to k each independently represent an integer of 0 to 3.)

The charge transport substance represented by formula (1), even when mixed with a binder resin, gives a photosensitive layer which has a considerably low surface hardness as compared with the case where conventional charge transport substances are used. The reasons therefor have not been fully elucidated. However, it is thought that since the molecule of the charge transport substance represented by formula (1) is rod-shaped and is stiff and long, this substance does not sufficiently mingle with the binder resin on a molecular level and is low in the ability to fill voids (free volume) within, in particular, the binder resin, and that the outermost layer hence has low circumferential denseness, resulting in the low surface hardness. Meanwhile, the compound represented by formula (5) has a small size and is low also in molecular polarity and in the symmetry of the molecular structure. It is thought that this compound is not high in crystallizability with respect to cohesion among the same molecules and also in the property of aggregating with the charge transport substance represented by formula (1) and, hence, moderately fills the free volume of the binder resin. However, it is not possible to use any compound which fills the free volume. Some compounds may undesirably fill areas to be occupied by the charge transport substance represented by formula (1), resulting in a deterioration, rather than an improvement, in electrical property. In addition, in case where a compound which itself shows high crystallizability and which is high in the property of aggregating with the charge transport substance represented by formula (1) is added, this compound cannot moderately fill the free volume. Namely, it is presumed that the charge transport substance represented by formula (1) and the compound represented by formula (5) have unusually high compatibility therebetween in the respect shown above.

The content of the compound represented by formula (5) in the photosensitive layer per 100 parts by mass of the binder resin is as follows. From the standpoint of filling voids, the lower limit thereof is usually 1 part by mass. From the standpoint of surface hardness, the lower limit thereof is preferably 3 parts by mass, more preferably 4 parts by mass. From the standpoint of the degree of elastic deformation, the upper limit thereof is usually 20 parts by mass. From the standpoints of plastic deformation and film properties, the upper limit thereof is preferably 15 parts by mass, more preferably 10 parts by mass.

Although any one of compounds represented by formula (5) is usually used, two or more thereof may be used as a mixture thereof. In this case, the total amount of these compounds to be used is preferably the same as in the case where one compound is used alone. Since the addition of the compound represented by formula (5) produces little influence on the electrical properties so long as the compound is used in an amount within that range, the charge-transporting ability of the charge transport substance represented by formula (1) can be sufficiently exhibited.

Next, preferred examples of the compound represented by formula (5) are explained. Specifically, from the standpoint of electrical properties, preferred examples thereof are compounds represented by the following formulae (2), (3), and (4).

Formula (2)

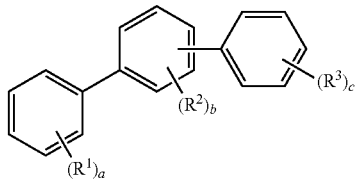

In formula (2), $R^1$ to $R^3$ each independently represent an alkyl group. Preferred examples of the alkyl group, from the standpoint of compatibility with the binder resin, are alkyl groups having 4 or less carbon atoms, such as methyl, ethyl, propyl, butyl, isopropyl, and t-butyl. Especially preferred is methyl. Symbols a, b, and c each independently represent an integer of 0 to 3. Symbols a and c are more preferably 0 to 2, even more preferably 0 or 1. Symbol b is more preferably 0 or 1, even more preferably 0. With respect to the positions of benzene ring substitution, it is preferable that the two benzene rings at both ends should be bonded to the central benzene ring at meta or ortho positions to each other, especially preferably at meta positions to each other, from the standpoint of compatibility with the binder resin. Preferred examples of the chemical structure of formula (2) are shown below.

(2)-1

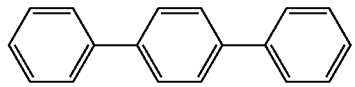

(2)-2

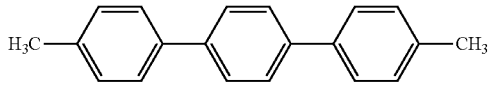

(2)-3

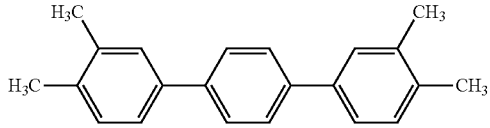

(2)-4

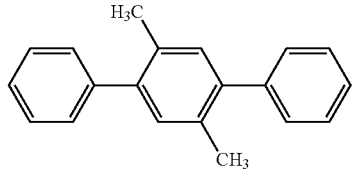

-continued (2)-5

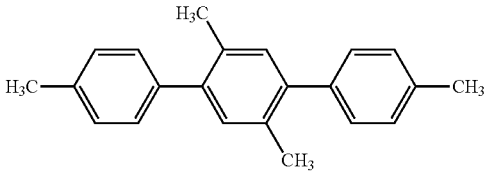

(2)-6

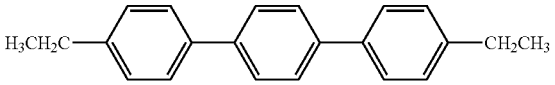

(2)-7

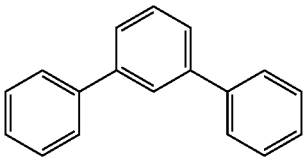

(2)-8

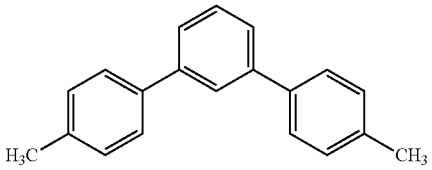

(2)-9

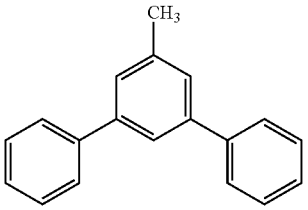

(2)-10

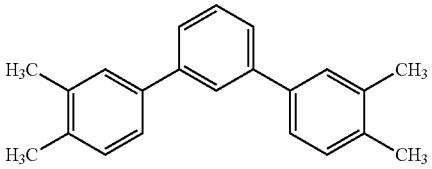

(2)-11

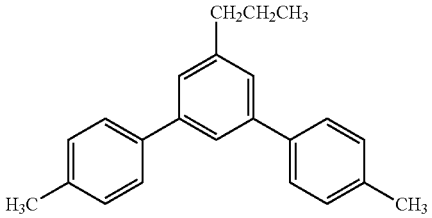

(2)-12

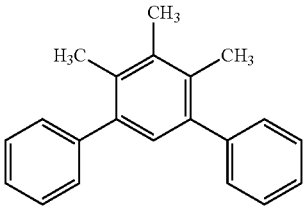

-continued (2)-13

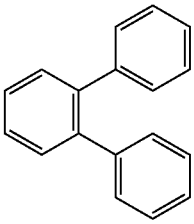

(2)-14

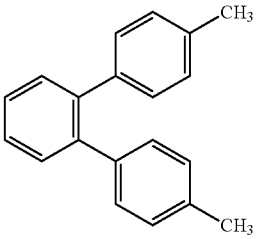

(2)-15

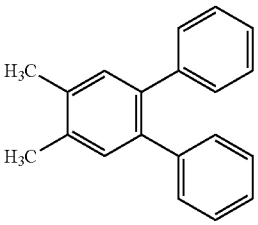

Formula (3)

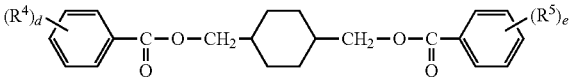

In formula (3), $R^4$ and $R^5$ each independently represent an alkyl group. Preferred examples of the alkyl group, from the standpoint of compatibility with the binder resin, are alkyl groups having 4 or less carbon atoms, such as methyl, ethyl, propyl, butyl, isopropyl, and t-butyl. Especially preferred is methyl. Symbols d and e each independently represent an integer of 0 to 3. Symbols d and e each are more preferably 0 to 2, even more preferably 0 or 1, and are especially preferably 1 from the standpoint of solubility. Preferred examples of the chemical structure of formula (3) are shown below.

(3)-1

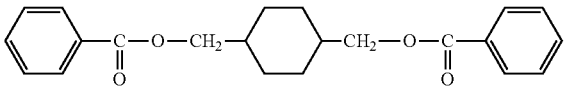

(3)-2

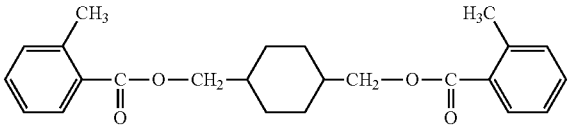

(3)-3

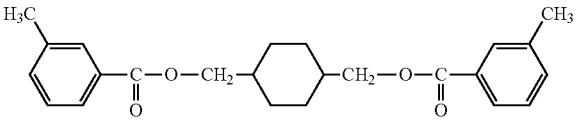

-continued (3)-4

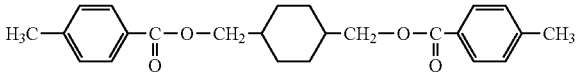

(3)-5

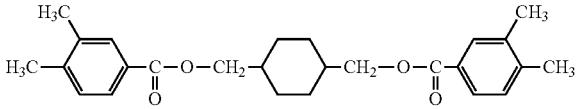

(3)-6

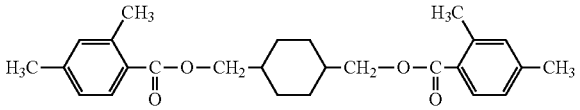

Formulal (4)

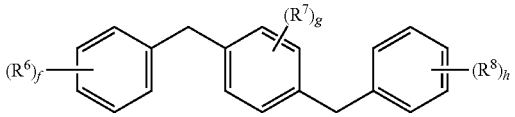

In formula (4), $R^6$ to $R^8$ each independently represent an alkyl group. Preferred examples of the alkyl group, from the standpoint of compatibility with the binder resin, are alkyl groups having 4 or less carbon atoms, such as methyl, ethyl, propyl, butyl, isopropyl, and t-butyl. Especially preferred is methyl. Symbols f, g, and h each independently represent an integer of 0 to 3. From the standpoint of solubility, f and h are more preferably 1 to 3, even more preferably 1 or 2. From the standpoint of ease of production, g is more preferably 0 to 2, even more preferably 0 or 1. Preferred examples of the chemical structure of formula (4) are shown below.

(4)-1

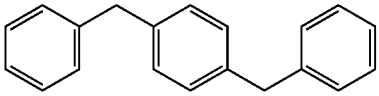

(4)-2

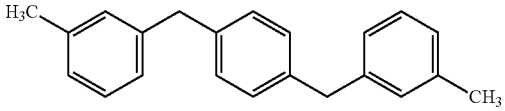

(4)-3

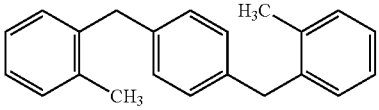

(4)-4

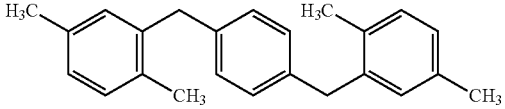

(4)-5

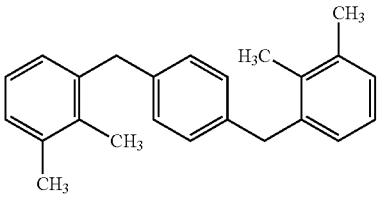

-continued (4)-6

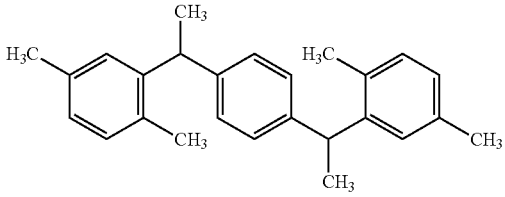

(4)-7

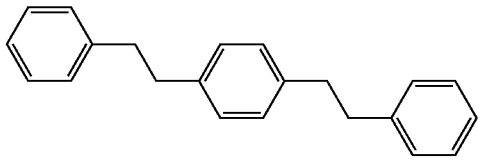

(4)-8

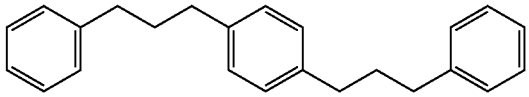

(4)-9

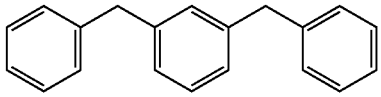

(4)-10

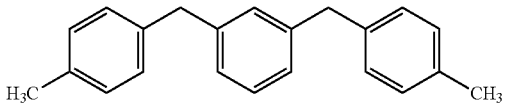

(4)-11

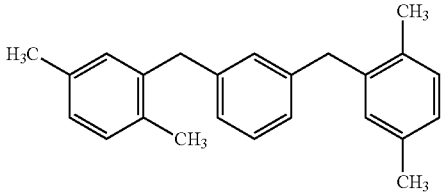

(4)-12

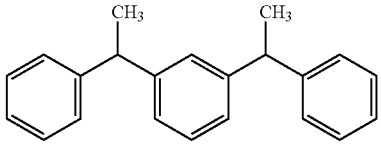

(4)-13

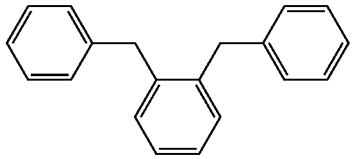

(4)-14

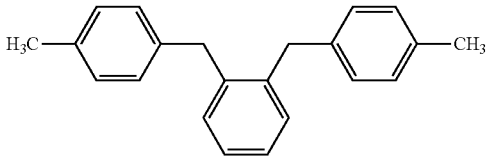

<Binder Resin>

It is preferable in the photoreceptor of the invention that a binder resin should be used in the same layer as the charge transport substance represented by formula (1) and as the compound represented by any of formulae (2) to (4), for the purpose of maintaining film strength. Suitable examples of the binder resin include polymers and copolymers of vinyl compounds, such as butadiene resins, styrene resins, vinyl acetate resins, vinyl chloride resins, acrylic ester resins, methacrylic ester resins, vinyl alcohol resins, and ethyl vinyl ether resins, and further include poly(vinyl butyral) resins, poly (vinyl formal) resins, partly modified poly(vinyl acetal), polyamide resins, polyurethane resins, cellulose ester resins, phenoxy resins, silicone resins, silicone/alkyd resins, poly(N-vinylcarbazole) resins, polycarbonate resins, and polyester resins. Preferred of these are polycarbonate resins and polyester resins. Polyester resins, in particular, wholly aromatic polyester resins called polyarylate resins, are capable of bringing about a higher degree of elastic deformation and are preferred from the standpoint of mechanical properties such as wear resistance, scratch resistance, and non-filming properties. In general, polyester resins are superior to polycarbonate resins in mechanical property but are inferior in polycarbonate resins in electrical property and photofatigue. This is thought to be because the ester bond has higher polarity than the carbonate bond and shows higher acceptor characteristics. Two or more of those resins may be used as a mixture thereof unless the function thereof is impaired.

First, polyester resins are explained. In general, a polyester resin is obtained by condensation-polymerizing starting-material monomers including a polyhydric alcohol ingredient and a polycarboxylic acid ingredient, e.g., a carboxylic cid, carboxylic acid anhydride, or carboxylic acid ester.

Examples of the polyhydric alcohol ingredient include alkylene (having 2 or 3 carbon atoms) oxide (average number of moles added, 1-10) adducts of bisphenol A, such as polyoxypropylene(2.2)-2,2-bis(4-hydroxyphenyl)propane and polyoxyethylene(2.2)-2,2-bis(4-hydroxyphenyl)propane, ethylene glycol, propylene glycol, neopentyl glycol, glycerin, pentaerythritol, trimethylolpropane, hydrogenated bisphenol A, sorbitol, alkylene (having 2 or 3 carbon atoms) oxide (average number of moles added, 1-10) adducts of these, and aromatic bisphenols. It is preferable that the polyhydric alcohol ingredient should include one or more of these compounds.

Meanwhile, examples of the polycarboxylic acid ingredient include dicarboxylic acids such as phthalic acid, isophthalic acid, terephthalic acid, fumaric acid, and maleic acid, succinic acids substituted with an alkyl group having 1-20 carbon atoms or alkenyl group having 2-20 carbon atoms, such as dodecenylsuccinic acid and octylsuccinic acid, trimellitic acid, pyromellitic acid, the anhydrides of these acids, and alkyl (having 1-3 carbon atoms) esters of these acids. It is preferable that the polycarboxylic acid ingredient should include one or more of these compounds.

Preferred of these polyester resins are wholly aromatic polyester resins (polyarylate resins) having a structural unit represented by the following formula (6).

Formula (6)

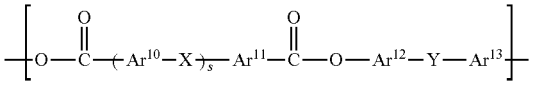

(In formula (6), $Ar^{10}$ to $Ar^{13}$ each independently represent an arylene group which may have a substituent, X represents a single bond, an oxygen atom, a sulfur atom, or an alkylene group, s represents an integer of 0 to 2, and Y represents a single bond, an oxygen atom, a sulfur atom, or an alkylene group.)

In formula (6), $Ar^{10}$ to $Ar^{13}$ each independently represent an arylene group which may have a substituent. The number of carbon atoms of the arylene group is usually 6 or more, and the upper limit thereof is usually 20, preferably 10, more preferably 6. In case where the number of carbon atoms thereof is too large, there is the possibility of resulting not only in an increase in production cost but in impaired electrical properties.

Examples of $Ar^{10}$ to $Ar^{13}$ include 1,2-phenylene, 1,3-phenylene, 1,4-phenylene, naphthylene, anthrylene, and phenanthrylene. Preferred of these examples of the arylene groups is 1,4-phenylene, from the standpoint of electrical properties. The arylene groups may be of one kind alone, or may be any desired combination of two or more kinds in any desired proportion.

Examples of the substituents which may be possessed by $Ar^{10}$ to $Ar^{13}$ include alkyl groups, aryl groups, halogen atoms, and alkoxy groups. When the mechanical properties of the binder resin for the photosensitive layer and the solubility thereof in coating fluids for photosensitive-layer formation are taken into account, preferred examples among those are methyl, ethyl, propyl, and isopropyl as alkyl groups, phenyl and naphthyl as aryl groups, fluorine, chlorine, bromine, and iodine atoms as halogen atoms, and methoxy, ethoxy, propoxy, and butoxy as alkoxy groups. In the case where any of the substituents is an alkyl group, the number of carbon atoms of the alkyl group is usually 1 or more and is usually 10 or less, preferably 8 or less, more preferably 2 or less.

More specifically, it is preferable that $Ar^{12}$ and $Ar^{13}$ should each independently have no substituent or have up to two substituents. From the standpoint of adhesiveness, it is more preferable that $Ar^{12}$ and $Ar^{13}$ each should have one or more substituents. In particular, from the standpoint of wear resistance, it is especially preferable that $Ar^{12}$ and $Ar^{13}$ each should have one substituent. Preferred as the substituents are alkyl groups. Especially preferred is methyl.

Meanwhile, with respect to $Ar^{10}$ and $Ar^{11}$, it is preferable that these groups should each independently have no substituent or have up to two substituents. From the standpoint of wear resistance, it is more preferable that $Ar^{10}$ and $Ar^{11}$ each should have no substituent.

In formula (6), Y is a single bond, oxygen atom, sulfur atom, or alkylene group. Preferred examples of the alkylene group are $—CH_2—$, $—CH(CH_3)—$, $—C(CH_3)_2—$, and cyclohexylene. More preferred are $—CH_2—$, $—CH(CH_3)—$, and $—C(CH_3)_2—$. Especially preferred are $—CH_2—$ and $—CH(CH_3)—$.

In formula (6), X is a single bond, oxygen atom, sulfur atom, or alkylene group. In particular, it is preferable that X should be an oxygen atom. In this case, it is especially preferable that s should be 1.

In the case where s is 1, preferred examples of the dicarboxylic acid residue include a diphenyl ether-2,2'-dicarboxylic acid residue, diphenyl ether-2,3'-dicarboxylic acid residue, diphenyl ether-2,4'-dicarboxylic acid residue, diphenyl ether-3,3'-dicarboxylic acid residue, diphenyl ether-3,4'-dicarboxylic acid residue, and diphenyl ether-4,4'-dicarboxylic acid residue. More preferred of these are a diphenyl ether-2,2'-dicarboxylic acid residue, diphenyl ether-2,4'-dicarboxylic acid residue, and diphenyl ether-4,4'-dicarboxylic acid residue, when the simplicity of production of the dicarboxylic acid ingredient is taken into account. Especially preferred is a diphenyl ether-4,4'-dicarboxylic acid residue.

In the case where s is 0, examples of the dicarboxylic acid residue include a phthalic acid residue, isophthalic acid residue, terephthalic acid residue, toluene-2,5-dicarboxylic acid residue, p-xylene-2,5-dicarboxylic acid residue, naphthalene-1,4-dicarboxylic acid residue, naphthalene-2,3-dicarboxylic acid residue, naphthalene-2,6-dicarboxylic acid residue, biphenyl-2,2'-dicarboxylic acid residue, and biphenyl-4,4'-dicarboxylic acid residue. Preferred are a phthalic acid residue, isophthalic acid residue, terephthalic acid residue, naphthalene-1,4-dicarboxylic acid residue, naphthalene-2,6-dicarboxylic acid residue, biphenyl-2,2'-dicarboxylic acid residue, and biphenyl-4,4'-dicarboxylic acid residue. Especially preferred are an isophthalic acid residue and a terephthalic acid residue. It is possible to use a plurality of these carboxylic acid residues in combination. Although the proportion of isophthalic acid residues to terephthalic acid residues is usually 50:50, the proportion thereof can be changed at will. In this case, the higher the proportion of terephthalic acid residues, the more the polyester resin is preferred from the standpoint of electrical properties.

The polyester resin to be used in the invention may have any desired viscosity-average molecular weight unless the effects of the invention are considerably lessened thereby. It is, however, desirable that the viscosity-average molecular weight thereof should be preferably 20,000 or higher, more preferably 30,000 or higher, and the upper limit thereof should be preferably 80,000, more preferably 70,000. In case where the viscosity-average molecular weight thereof is too low, there is a possibility that this polyester resin might have insufficient mechanical strength. In case where the viscosity-average molecular weight thereof is too high, there is a possibility that the coating fluid for photosensitive-layer formation might have too high viscosity, resulting in a decrease in production efficiency. Viscosity-average molecular weight can be determined, for example, with a Ubbelohde capillary viscometer by the method which will be described in Examples.

Next, polycarbonate resins are explained. Known polycarbonate resins include: polycarbonate resins produced by solvent processes, such as an interfacial process (interfacial polycondensation) or a solution process, in which a bisphenol compound is reacted with phosgene in solution; and polycarbonate resins produced by a melt process in which a bisphenol and a carbonic acid diester are subjected to polycondensation reaction by transesterification. Of these, the polycarbonate resins produced by the interfacial process are in extensive use in electrophotographic photoreceptor applications because these polycarbonate resins can be produced so as to have a higher molecular weight and can be purified by liquid/liquid washing and because the process is applicable to various bisphenols. However, the interfacial process has a problem concerning safety since phosgene is used as a starting material. Meanwhile, the polycarbonate resins produced by the melt process have drawbacks that the kinds of bisphenols which can be polymerized are limited and that it is difficult to heighten the molecular weight of the resins and to remove impurities therefrom by washing. However, the polycarbonate resins by the melt process have a merit concerning safety because of the nonuse of phosgene in the polymerization step, and use of these resins in electrophotographic photoreceptor applications is being investigated.

In the electrophotographic photoreceptor of the invention, use can be made of any one of or a mixture of two or more of polycarbonate resins obtained by polymerizing or copolymerizing one or two or more known bisphenols. Suitable for use, among the known bisphenols, are polycarbonate resins including the structural unit represented by the following formula (7), from the standpoints of electrical properties, surface hardness, degree of elastic deformation, and adhesiveness.

Formula (7)

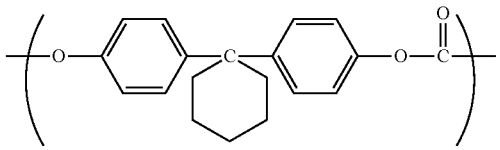

Although the polycarbonate resin to be used in the invention may be a homopolymer composed of units of the one kind represented by formula (7), the polycarbonate resin may be a block or random copolymer with other kind(s) of bisphenol units. Examples of bisphenols which may be copolymerized are shown below. With respect to copolymerization ratio, the proportion of the unit of formula (7) may be 50% by mass or higher, more preferably 60% by mass or higher.

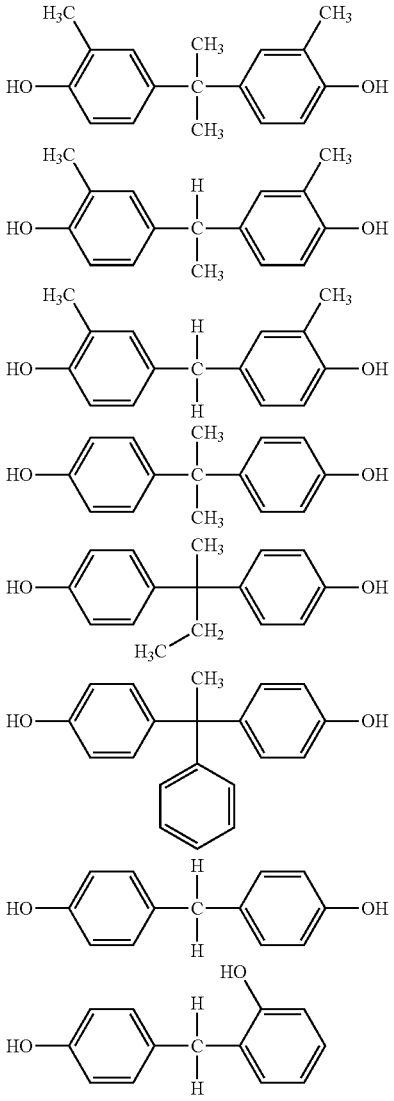

-continued

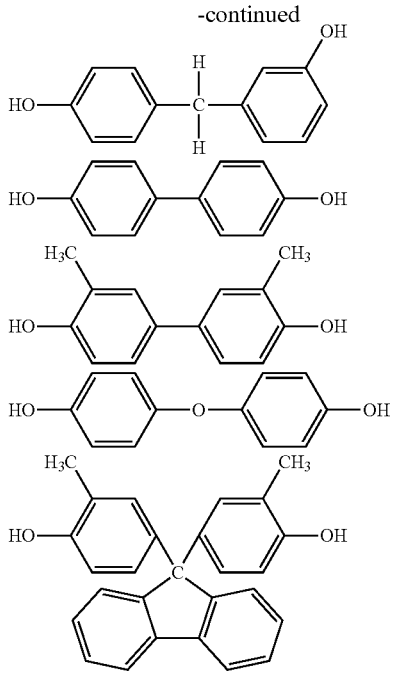

A preferred range of the viscosity-average molecular weight of the polycarbonate resin to be used in the invention is the same as that for the polyester resin.

In the electrophotographic photoreceptor including a photosensitive layer formed over a conductive support, the polyester resin having a component represented by formula (6) and the polycarbonate resin having the component represented by formula (7) are incorporated into a layer which constitutes the outermost surface. However, in the case where a protective layer is disposed on the photosensitive layer as will be described below in detail, these resins are incorporated into the protective layer.

<<Electrophotographic Photoreceptor>>

Configurations of the electrophotographic photoreceptor of the invention are explained below. Configurations of the electrophotographic photoreceptor of the invention are not particularly limited so long as the photoreceptor is one in which a layer including both a charge transport substance represented by formula (1) and a compound represented by formula (5) together with a binder resin has been disposed over a conductive support so as to constitute the outermost surface. In the case where the photosensitive layer of the electrophotographic photoreceptor is of the multilayer type which will be described later, this photoreceptor may be one in which the charge transport layer contains a charge transport substance represented by formula (1) and a compound represented by formula (5) and optionally further contains additives such as an antioxidant, leveling agent, etc. according to need. In the case where the photosensitive layer of the electrophotographic photoreceptor is of the single-layer type which will be described later, a charge generation material and an electron transport material are generally used besides the ingredients used for the charge transport layer of the multilayer type photosensitive layer.

<Conductive Support>

The conductive support is not particularly limited. Examples of conductive supports in main use include: metallic materials such as aluminum, aluminum alloys, stainless steel, copper, and nickel; resinous materials to which electrical conductivity has been imparted by adding a conductive powder, e.g., a metal, carbon, or tin oxide powder; and resins, glasses, paper, or the like, the surface of which has been coated with a conductive material, e.g., aluminum, nickel, or ITO (indium-tin oxide), by vapor deposition or coating fluid application. One of these materials may be used alone, or any desired combination of two or more thereof may be used in any desired proportion. With respect to the form of the conductive support, the conductive support may be in the form of a drum, sheet, belt, or the like. Furthermore, use may be made of a conductive support which is made of a metallic material and which has been coated with a conductive material having an appropriate resistance value for the purposes of controlling conductivity, surface properties, etc. and of covering defects.

In the case where a metallic material such as an aluminum alloy is used as a conductive support, this material may be used after an anodized coating is formed thereon. In the case where an anodized coating has been formed, it is desirable to subject the material to a pore-filling treatment by a known method.

The surface of the conductive support may be smooth, or may have been roughened by using a special machining method or by performing a grinding treatment. Alternatively, use may be made of a conductive support having a roughened surface obtained by incorporating particles with an appropriate particle diameter into the material for constituting the support. Furthermore, a drawn pipe can be used as such without subjecting the pipe to machining, for the purpose of cost reduction.

<Undercoat Layer>

An undercoat layer may be disposed between the conductive support and the photosensitive layer which will be described later, in order to improve adhesion, blocking resistance, etc. As the material of the undercoat layer, use may be made, for example, of a resin or a resin in which particles of a metal oxide or the like have been dispersed. The undercoat layer may be constituted of a single layer or composed of a plurality of layers.

Examples of the metal oxide particles for use in the undercoat layer include particles of a metal oxide containing one metallic element, such as titanium oxide, aluminum oxide, silicon oxide, zirconium oxide, zinc oxide, or iron oxide, and particles of a metal oxide containing a plurality of metallic elements, such as calcium titanate, strontium titanate, or barium titanate. Particles of one kind selected from these may be used alone, or particles of two or more kinds may be mixed together and used. Preferred of those particulate metal oxides are titanium oxide and aluminum oxide. Especially preferred is titanium oxide. The titanium oxide particles may be ones, the surface of which has been treated with an inorganic substance such as tin oxide, aluminum oxide, antimony oxide, zirconium oxide, or silicon oxide or with an organic substance such as stearic acid, a polyol, or a silicone. With respect to the crystal form of the titanium oxide particles, any of rutile, anatase, brookite, and amorphous ones is usable. Furthermore, the titanium oxide particles may include particles in a plurality of crystal states.

Metal oxide particles having various particle diameters can be utilized. However, from the standpoints of properties and the stability of the fluid, the metal oxide particles to be used have an average primary-particle diameter of preferably 10-100 nm, especially preferably 10-50 nm. The average primary-particle diameter can be obtained from TEM photographs, etc.

It is desirable that the undercoat layer should be formed so as to be configured of a binder resin and metal oxide particles dispersed therein. Examples of the binder resin for use in the undercoat layer include known binder resins such as epoxy resins, polyethylene resins, polypropylene resins, acrylic resins, methacrylic resins, polyamide resins, vinyl chloride resins, vinyl acetate resins, phenolic resins, polycarbonate resins, polyurethane resins, polyimide resins, vinylidene chloride resins, poly(vinyl acetal) resins, vinyl chloride/vinyl acetate copolymers, poly(vinyl alcohol) resins, polyurethane resins, polyacrylic resins, polyacrylamide resins, polyvinylpyrrolidone resins, polyvinylpyridine resins, water-soluble polyester resins, cellulose ester resins such as nitrocellulose, cellulose ether resins, casein, gelatin, poly (glutamic acid), starch, starch acetate, aminostarch, organozirconium compounds such as zirconium chelate compounds and zirconium alkoxide compounds, organotitanium compounds such as titanium chelate compounds and titanium alkoxide compounds, and silane coupling agents. One of these binder resins may be used alone, or any desired combination of two or more thereof may be used in any desired proportion. A binder resin may be used together with a hardener to give a cured layer. Preferred of those binder resins are alcohol-soluble copolyamides, modified polyamides, and the like, because these resins show satisfactory dispersibility and applicability.

The proportion of the inorganic particles to the binder resin to be used for the undercoat layer can be selected at will. From the standpoint of the stability and applicability of the dispersion, however, it is usually preferred to use the inorganic particles in an amount in the range of 10-500% by mass based on the binder resin.

The undercoat layer has any desired thickness unless the effects of the invention are considerably lessened. However, from the standpoints of improving the electrical properties, suitability for intense exposure, image characteristics, and suitability for repetitions of the electrophotographic photoreceptor and improving coating-fluid applicability during production, the thickness thereof is usually 0.01 μm or larger, preferably 0.1 μm or larger, and is usually 30 μm or less, preferably 20 μm or less. A known antioxidant, etc. may be incorporated into the undercoat layer. Pigment particles, resin particles, or the like may be incorporated for the purpose of, for example, preventing the occurrence of image defects.

<Photosensitive Layer>

The photosensitive layer is formed on the conductive support described above (or on the undercoat layer described above when the undercoat layer has been disposed). It is preferable that the photosensitive layer should be an outermost layer which contains both the charge transport substance represented by general formula (1) described above and a compound represented by formula (5). Examples of types of this layer include: a photosensitive layer of the single-layer structure in which a charge generation material and a charge transport material (including the charge transport substance according to the invention) are present in the same layer so as to be in the state of having been dispersed in a binder resin (hereinafter suitably referred to as "single-layer type photosensitive layer"); and a photosensitive layer of the function allocation type having a multilayer structure composed of two or more layers including a charge generation layer in which a charge generation material has been dispersed in a binder resin and a charge transport layer in which a charge transport material (including the charge transport substance according to the invention) has been dispersed in a binder resin (hereinafter suitably referred to as "multilayer type photosensitive layer"). The photosensitive layer may be either of these types.

Examples of the multilayer type photosensitive layer include: a normal-stack type photosensitive layer in which a charge generation layer and a charge transport layer have been stacked and disposed in this order from the conductive support side; and a reverse-stack type photosensitive layer in which a charge transport layer and a charge generation layer have been stacked and disposed in this order from the conductive support side. Although either type can be employed, the normal-stack type photosensitive layer is preferred because this photosensitive layer can exhibit an especially well balanced photoconductivity.

<Multilayer Type Photosensitive Layer>

[Charge Generation Layer]

The charge generation layer of the multilayer type photosensitive layer (function allocation type photosensitive layer) contains a charge generation material and usually further contains a binder resin and other ingredients which are used according to need. Such a charge generation layer can be obtained, for example, by dissolving or dispersing a charge generation material and a binder resin in a solvent or dispersion medium to produce a coating fluid, applying this coating fluid on a conductive support in the case of a normal-stack type photosensitive layer (or on an undercoat layer in the case where the undercoat layer has been disposed) or applying the coating fluid on a charge transport layer in the case of a reverse-stack type photosensitive layer, and drying the coating fluid applied.

Examples of the charge generation substance include inorganic photoconductive materials such as selenium, alloys thereof, and cadmium sulfide and organic photoconductive materials such as organic pigments. However, organic photoconductive materials are preferred, and organic pigments are especially preferred of these. Examples of the organic pigments include phthalocyanine pigments, azo pigments, dithioketopyrrolopyrrole pigments, squalene (squarylium) pigments, quinacridone pigments, indigo pigments, perylene pigments, polycyclic quinone pigments, anthanthrone pigments, and benzimidazole pigments. Especially preferred of these are phthalocyanine pigments or azo pigments. In the case where an organic pigment is used as the charge generation substance, any of these organic pigments is used usually in the form of a dispersion layer in which fine particles of the organic pigment have been bound with a binder resin of any of various kinds.

In the case where a phthalocyanine pigment is used as the charge generation substance, usable phthalocyanines specifically include phthalocyanines having different crystal forms such as metal-free phthalocyanines and phthalocyanine compounds to which a metal, e.g., copper, indium, gallium, tin, titanium, zinc, vanadium, silicon, germanium, or aluminum, or an oxide, halide, hydroxide, alkoxide, or another form of the metal has coordinated, and further include phthalocyanine dimmers or the like in which an oxygen atom or the like is used as a crosslinking atom. Especially suitable are X-form and τ-form metal-free phthalocyanines, which are crystal forms having high sensitivity, A-form (also called β-form), B-form (also called α-form), D-form (also called Y-form), and other titanyl phthalocyanines (another name: oxytitanium phthalocyanines), vanadyl phthalocyanines, chloroindium phthalocyanines, hydroxyindium phthalocyanines, II-form and other chlorogallium phthalocyanines, V-form and other hydroxygallium phthalocyanines, G-form, I-form, and other μ-oxogallium phthalocyanine dimers, and II-form and other μ-oxoaluminum phthalocyanine dimers.

Especially preferred of these phthalocyanines are A-form (also called β-form), B-form (also called α-form), D-form (Y-form) titanyl phthalocyanine which is characterized by showing a distinct peak at a diffraction angle 2θ(±0.2°) of 27.1° or 27.3° in X-ray powder diffractometry, II-form chlorogallium phthalocyanine, V-form hydroxygallium phthalocyanine, hydroxygallium phthalocyanine which has a highest peak at 28.1°, hydroxygallium phthalocyanine characterized by having no peak at 26.2° but having a distinct peak at 28.1° and by having a half-value width at 25.9°, W, of 0.1°≤W≤0.4°, G-form μ-oxogallium phthalocyanine dimer, and the like.

It is preferable that the oxytitanium phthalocyanine crystals should be crystals which, when examined with a CuKα characteristic X-ray line (wavelength, 1.541 Å), has main diffraction peaks at Bragg angles (2θ±0.2°) of 24.1° and 27.2°. With respect to other diffraction peaks, since crystals having a peak around 26.2° show poor crystal stability when dispersed, it is preferable that the oxytitanium phthalocyanine crystals should have no peak around 26.2°. In particular, crystals having main diffraction peaks at 7.3°, 9.6°, 11.6°, 14.2°, 18.0°, 24.1°, and 27.2° or having main diffraction peaks at 7.3°, 9.5°, 9.7°, 11.6°, 14.2°, 18.0°, 24.2°, and 27.2° are more preferred from the standpoint of the dark decay and residual potential of the electrophotographic photoreceptor in which the crystals are used.

In the case where a metal-free phthalocyanine compound or a metal-containing phthalocyanine compound is used as the charge generation substance, a photoreceptor which is highly sensitive to relatively long-wavelength laser light, e.g., laser light having a wavelength of about 780 nm, is obtained. In the case where an azo pigment such as a monoazo, diazo, or trisazo pigment is used, it is possible to obtain a photoreceptor which has sufficient sensitivity to white light, laser light having a wavelength of about 660 nm, or laser light having a relatively short wavelength (e.g., laser light having a wavelength in the range of 380-500 nm).

A single phthalocyanine compound may be used alone, or a mixture of some phthalocyanine compounds or a mixture of some crystal states may be used. This mixed state of phthalocyanine compounds or of crystal states to be used here may be a mixture obtained by mixing the components prepared beforehand, or may be a mixture which came into the mixed state during phthalocyanine compound production/treatment steps such as synthesis, pigment formation, crystallization, etc. Known as such treatment steps include an acid paste treatment, grinding, solvent treatment, and the like. Examples of methods for obtaining a mixed-crystal state include a method in which two kinds of crystals are mixed, subsequently mechanically ground to render the crystals amorphous, and then subjected to a solvent treatment to convert into specific crystal states, as described in JP-A-10-48859.

Meanwhile, in the case of using an azo pigment as the charge generation material, various conventionally known azo pigments can be used so long as the azo pigments have sensitivity to the light source for light input. However, various kinds of bisazo pigments and trisazo pigments are suitable.

In the case where one or more of the organic pigments shown above as examples are used as the charge generation substance, two or more pigments may be used as a mixture thereof although one of the azo pigments may be used alone. In this case, it is preferable that two or more charge generation substances which have spectral sensitivity characteristics in different spectral regions, i.e., the visible region and the near-infrared region, should be used in combination. More preferred of such methods is to use a disazo pigment or trisazo pigment and a phthalocyanine pigment in combination.

The binder resin to be used for the charge generation layer as a component of the multilayer type photosensitive layer is not particularly limited. Examples thereof include: insulating resins such as poly(vinyl acetal) resins, e.g., poly(vinyl butyral) resins, poly(vinyl formal) resins, and partly acetalized poly(vinyl butyral) resins in which the butyral moieties have been partly modified with formal, acetal, or the like, polyarylate resins, polycarbonate resins, polyester resins, modified ether-type polyester resins, phenoxy resins, poly (vinyl chloride) resins, poly(vinylidene chloride) resins, poly (vinyl acetate) resins, polystyrene resins, acrylic resins, methacrylic resins, polyacrylamide resins, polyamide resins, polyvinylpyridine resins, cellulosic resins, polyurethane resins, epoxy resins, silicone resins, poly(vinyl alcohol) resins, polyvinylpyrrolidone resins, casein, copolymers based on vinyl chloride and vinyl acetate, e.g., vinyl chloride/vinyl acetate copolymers, hydroxy-modified vinyl chloride/vinyl acetate copolymers, carboxyl-modified vinyl chloride/vinyl acetate copolymers, and vinyl chloride/vinyl acetate/maleic anhydride copolymers, styrene/butadiene copolymers, vinylidene chloride/acrylonitrile copolymers, styrene-alkyd resins, silicone-alkyd resins, and phenol-formaldehyde resins; and organic photoconductive polymers such as poly-N-vinylcarbazole, polyvinylanthracene, and polyvinylperylene. Any one of these binder resins may be used alone, or any desired combination of two or more thereof may be used as a mixture thereof.

The charge generation layer is formed specifically by dissolving the binder resin described above in an organic solvent, dispersing a charge generation substance in the resultant solution to prepare a coating fluid, and applying this coating fluid on a conductive support (or on an undercoat layer when the undercoat layer has been disposed).

The solvent to be used for producing the coating fluid is not particularly limited so long as the binder resin dissolves therein. Examples thereof include saturated aliphatic solvents such as pentane, hexane, octane, and nonane, aromatic solvents such as toluene, xylene, and anisole, halogenated aromatic solvents such as chlorobenzene, dichlorobenzene, and chloronaphthalene, amide solvents such as dimethylformamide and N-methyl-2-pyrrolidone, alcohol solvents such as methanol, ethanol, isopropanol, n-butanol, and benzyl alcohol, aliphatic polyhydric alcohols such as glycerin and polyethylene glycol, chain or cyclic ketone solvents such as acetone, cyclohexanone, methyl ethyl ketone, and 4-methoxy-4-methyl-2-pentanone, ester solvents such as methyl formate, ethyl acetate, and n-butyl acetate, halogenated hydrocarbon solvents such as methylene chloride, chloroform, and 1,2-dichloroethane, chain or cyclic ether solvents such as diethyl ether, dimethoxyethane, tetrahydrofuran, 1,4-dioxane, methyl Cellosolve, and ethyl Cellosolve, aprotic polar solvents such as acetonitrile, dimethyl sulfoxide, sulfolane, and hexamethylphosphoric triamide, nitrogen-containing compounds such as n-butylamine, isopropanolamine, diethylamine, triethanolamine, ethylenediamine, triethylenediamine, and triethylamine, mineral oils such as ligroin, and water. One of these solvents may be used alone, or two or more thereof may be used in combination. In the case where the undercoat layer described above is disposed, solvents in which this undercoat layer does not dissolve are preferred.

In the charge generation layer, the mixing ratio (mass ratio) of the binder resin and the charge generation substance is in such a range that the amount of the charge generation substance per 100 parts by mass of the binder resin is usually 10 parts by mass or larger, preferably 30 parts by mass or larger, and is usually 1,000 parts by mass or less, preferably 500 parts by mass or less. The thickness of the charge generation layer is usually 0.1 μm or larger, preferably 0.15 μm or larger, and is usually 10 μm or less, preferably 0.6 μm or less. In case where the proportion of the charge generation substance is too high, there is a possibility that the stability of the coating fluid might decrease due to aggregation of the charge generation substance. Meanwhile, in case where the proportion of the charge generation substance is too low, there is the possibility of resulting in a decrease in the sensitivity of the photoreceptor.

For dispersing the charge generation substance, known dispersing techniques can be used, such as ball mill dispersion, attritor dispersion, and sand mill dispersion. In this case, it is preferred to finely reduce the particles to a particle size of 0.5 μm or less, preferably 0.3 μm or less, more preferably 0.15 μm or less.

<Charge Transport Layer>

The charge transport layer of the multilayer type photosensitive layer contains the charge transport substance described above and a binder resin and may further contain other ingredients which are used according to need. Such a charge transport layer can be obtained specifically by dissolving or dispersing the charge transport substance, etc. and a binder resin in a solvent to produce a coating fluid, applying this coating fluid on the charge generation layer in the case of a normal-stack type photosensitive layer or applying the coating fluid on a conductive support (or on an undercoat layer when the undercoat layer has been disposed) in the case of a reverse-stack type photosensitive layer, and drying the coating fluid applied.

The charge transport substance represented by formula (1) described above may be used in combination with a known charge transport substance. In the case of using another charge transport substance in combination with the charge transport substance represented by formula (1), the kind thereof is not particularly limited. However, preferred charge transport substances which can be optionally used are, for example, carbazole derivatives, hydrazone compounds, aromatic amine derivatives, enamine derivatives, butadiene derivatives, and compounds each constituted of two or more of these derivatives bonded to each other. Any one of these charge transport substances may be used alone, or any desired two or more thereof may be used in combination.

The thickness of the charge transport layer is not particularly limited. However, from the standpoints of long life and image stability and of charge stability, the thickness thereof is usually 5 μm or larger, preferably 10 μm or larger, but is usually 50 μm or less, preferably 45 μm or less, more preferably 30 μm or less. From the standpoint of higher resolution, a thickness thereof of 25 μm or less is especially suitable.

<Single-Layer Type Photosensitive Layer>

The single-layer type photosensitive layer is formed using a charge generation substance, the charge transport substance represented by formula (1), and the compound represented by formula (5) and further using a binder resin in order to ensure film strength as in the charge transport layer of the multilayer type photosensitive layer. Specifically, the single-layer type photosensitive layer can be obtained by dissolving or dispersing a charge generation substance, the charge transport substance, the compound represented by formula (5), and any of various binder resins in a solvent to produce a coating fluid, applying the coating fluid on a conductive support (or on an undercoat layer when the undercoat layer has been disposed), and drying the coating fluid applied.

The kinds of the charge transport substance represented by formula (1), compound represented by formula (5), and binder resin and the ratio of these ingredients to be used may be the same as explained above with regard to the charge transport layer of the multilayer type photosensitive layer.

As the charge generation substance, the same charge generation substances as those explained above with regard to the charge generation layer of the multilayer type photosensitive layer can be used. In the case of the single-layer type photosensitive layer, however, it is necessary to regulate the charge generation substance so as to have a sufficiently reduced particle diameter. Specifically, the particle diameter of the charge generation substance is regulated to usually 1 μm or less, preferably 0.5 μm or less.

With respect to the ratio of the binder resin and charge generation substance used in the single-layer type photosensitive layer, the proportion of the charge generation substance per 100 parts by mass of the binder resin is usually 0.1 part by mass or larger, preferably 1 part by mass or larger, and is usually 30 parts by mass or less, preferably 10 parts by mass or less.

The thickness of the single-layer type photosensitive layer is usually 5 μm or larger, preferably 10 μm or larger, and is usually 100 μm or less, preferably 50 μm or less.

<Other Additives>

Known additives, e.g., an antioxidant, plasticizer, ultraviolet absorber, electron-attracting compound, leveling agent, and visible-light-shielding agent, may be incorporated into each of the multilayer type photosensitive layer and the single-layer type photosensitive layer or into the layers constituting the photosensitive layer, for the purpose of improving film-forming properties, flexibility, applicability, non-fouling properties, gas resistance, light resistance, etc.

<Other Functional Layers>

In either the multilayer type photosensitive layer or the single-layer type photosensitive layer, the photosensitive layer formed in the manner described above may be an uppermost layer, i.e., a surface layer. It is, however, possible to further dispose another layer as a surface layer on the photosensitive layer. For example, a protective layer may be disposed for the purpose of preventing the photosensitive layer from being damaged or wearing or of preventing or lessening the deterioration of the photosensitive layer caused by, for example, discharge products generated from the charging device, etc. In this case, the protective layer contains the charge transport substance represented by formula (1), the compound represented by formula (5), and a binder resin.

It is desirable that the protective layer should have an electrical resistance usually in the range of $10^9$-$10^{14}$ Ω·cm. In case where the electrical resistance thereof is higher than the upper limit of that range, the photoreceptor has an elevated residual potential to give fogged images. Meanwhile, in case where the electrical resistance thereof is lower than the lower limit of that range, the results are image blurring and a decrease in resolution. The protective layer must be configured so that this layer does not substantially prevent the transmission of the light with which the photoreceptor is irradiated for exposure.

A fluororesin, silicone resin, polyethylene resin, or the like, particles of any of these resins, or particles of an inorganic compound may be incorporated into the surface layer for the purposes of reducing the frictional resistance and wear of the photoreceptor surface, heightening the efficiency of toner transfer from the photoreceptor to a transfer belt and to paper, etc.

<Universal Hardness/Degree of Elastic Deformation of Outermost Layer>

The universal hardness of the outermost layer is as follows. The lower limit thereof is usually 135 N/m$^2$ from the standpoint of scratch prevention, and is preferably 140 N/mm$^2$, more preferably 150 N/mm$^2$, from the standpoint of noise prevention. From the standpoint of the amount of elastic deformation, the upper limit of the universal hardness thereof is usually 200 N/mm$^2$, preferably 180 N/mm$^2$, more preferably 160 N/mm$^2$. The degree of elastic deformation of the outermost layer is preferably 38% or higher from the standpoint of wear resistance, and is more preferably 40% or higher from the standpoint of preventing the occurrence of scratches, cleaning failures, and toner adhesion. It is preferred to use a polyarylate resin from the standpoint of enabling the outermost layer to retain a high degree of elastic deformation. The degree of elastic deformation is measured with microhardness meter FISCHERSCOPE H100C, manufactured by Fischer (or with HM2000 manufactured by the same company, which is equal in performance), in an atmosphere having a temperature of 25° C. and a relative humidity of 50%. For the measurement, use is made of a Vickers square-based diamond pyramid indenter in which the angle between non-adjacent faces is 136°.

<Method for Forming Each Layer>

The layers for constituting the photoreceptor are formed in the following manner. The substances to be incorporated into each layer are dissolved or dispersed in a solvent to obtain a coating fluid. The coating fluids thus obtained for the respective layers are successively applied on a conductive support by a known technique, such as dip coating, spray coating, nozzle coating, bar coating, roll coating, or blade coating, and dried. By repeating this application/drying step for each layer, the constituent layers are formed.

The solvent or dispersion medium to be used for producing the coating fluids is not particularly limited. However, examples thereof include alcohols such as methanol, ethanol, propanol, and 2-methoxyethanol, ethers such as tetrahydrofuran, 1,4-dioxane, and dimethoxyethane, esters such as methyl formate and ethyl acetate, ketones such as acetone, methyl ethyl ketone, cyclohexanone, and 4-methoxy-4-methyl-2-pentanone, aromatic hydrocarbons such as benzene, toluene, and xylene, chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichloroethylene, nitrogen-containing compounds such as n-butylamine, isopropanolamine, diethylamine, triethanolamine, ethylenediamine, and triethylenediamine, and aprotic polar solvents such as acetonitrile, N-methylpyrrolidone, N,N-dimethylformamide, and dimethyl sulfoxide. One of these compounds may be used alone, or any desired two or more compounds of any desired kind(s) may be used in combination.

The amount of the solvent or dispersion medium to be used is not particularly limited. It is, however, preferred to suitably regulate the amount thereof so that the properties of the coating fluid, such as solid concentration and viscosity, are within desired ranges, while taking account of the purpose of each layer and the nature of the selected solvent or dispersion medium.

For example, in the case of the single-layer type photosensitive layer and of the charge transport layer of the function allocation type photosensitive layer, the solid concentration of each coating fluid is usually 5% by mass or higher, preferably 10% by mass or higher, and is usually 40% by mass or less, preferably 35% by mass or less. Furthermore, the viscosity of this coating fluid, as measured at the temperature at which the coating fluid is used, is usually 10 mPa·s or higher, preferably 50 mPa·s or higher, and is usually 500 mPa·s or less, preferably 400 mPa·s or less.

Meanwhile, in the case of the charge generation layer of the multilayer type photosensitive layer, the solid concentration of the coating fluid is usually 0.1% by mass or higher, preferably 1% by mass or higher, and is usually 15% by mass or less, preferably 10% by mass or less. The viscosity of this coating fluid, as measured at the temperature at which the coating fluid is used, is usually 0.01 mPa·s or higher, preferably 0.1 mPa·s or higher, and is usually 20 mPa·s or less, preferably 10 mPa·s or less.

Examples of techniques for applying the coating fluids include dip coating, spray coating, spinner coating, bead coating, wire-wound bar coating, blade coating, roller coating, air-knife coating, and curtain coating. It is also possible to use other known coating techniques.

In a preferred method for drying each coating fluid, the coating fluid applied is dried at room temperature until the coating film becomes dry to the touch, and is thereafter dried with heating at a temperature usually in the range of 30-200° C. for a period of 1 minute to 2 hours, stationarily or with air blowing. The heating temperature may be constant, or the heating for drying may be conducted while changing the temperature.

<<Image Forming Apparatus>>

Next, embodiments of the image forming apparatus (image forming apparatus of the invention) which employs the electrophotographic photoreceptor of the invention are explained by reference to FIG. 1, which illustrates the configuration of important parts of the apparatus. It is, however, noted that embodiments of the apparatus are not limited to the following explanations and the apparatus can be modified at will unless the modifications depart from the spirit of the invention.

As shown in FIG. 1, the image forming apparatus is configured so as to be equipped with an electrophotographic photoreceptor 1, a charging device 2, an exposure device 3, and a developing device 4. The apparatus is further provided with a transfer device 5, a cleaner 6, and a fixing device 7 according to need.

The electrophotographic photoreceptor 1 is not particularly limited so long as it is the electrophotographic photoreceptor of the invention described above. FIG. 1 shows, as an example thereof, a drum-shaped photoreceptor obtained by forming the photosensitive layer described above on the surface of a cylindrical conductive support. The charging device 2, exposure device 3, developing device 4, transfer device 5, and cleaner 6 have been disposed along the peripheral surface of this electrophotographic photoreceptor 1.

The charging device 2 serves to charge the electrophotographic photoreceptor 1. This device evenly charges the surface of the electrophotographic photoreceptor 1 to a given potential. Frequently used as the charging device is a corona charging device, such as a corotron or a scorotron, a direct charging device in which a direct charging member to which a voltage is being applied is brought into contact with the photoreceptor surface to charge the surface (contact type charging device), or the like. Examples of the direct charging device include charging rollers and charging brushes. FIG. 1 shows a roller type charging device (charging roller) as an example of the charging device 2. Either charging which is accompanied with aerial discharge or injection charging which is not accompanied with aerial discharge is a possible means for direct charging. As the voltage to be applied for the charging, a direct-current voltage only can be used or an alternating current superimposed on a direct current is also usable.

The exposure device 3 is not particularly limited in the kind thereof so long as the device can illuminate the electrophotographic photoreceptor 1 and thereby form an electrostatic latent image on the photosensitive surface of the electrophotographic photoreceptor 1. Examples thereof include halogen lamps, fluorescent lamps, lasers such as semiconductor lasers and He—Ne lasers, and LEDs. It is also possible to conduct exposure by the technique of internal photoreceptor exposure. Any desired light may be used for exposure. For example, monochromatic light having a wavelength of 780 nm, monochromatic light having a slightly short wavelength of 600-700 nm, monochromatic light having a short wavelength of 380-500 nm, or the like may be used to conduct exposure.

The developing device 4 is not particularly limited in the kind thereof, and any desired device can be used, such as a device operated by a dry development technique, e.g., cascade development, development with one-component insulating toner, development with one-component conductive toner, or two-component magnetic-brush development, or by a wet development technique, etc. In FIG. 1, the developing device 4 includes a developing vessel 41, agitators 42, a feed roller 43, a developing roller 44, and a control member 45. This device has been configured so that a toner T is stored in the developing vessel 41. According to need, the developing device 4 may be equipped with a replenishing device (not shown) for replenishing the toner T. This replenishing device is configured so that the toner T can be replenished from a container, e.g., a bottle or a cartridge.

The feed roller 43 is made of a conductive sponge, etc. The developing roller 44 is constituted of, for example, a metallic roll made of iron, stainless steel, aluminum, nickel, or the like or a resinous roll obtained by coating such a metallic roll with a silicone resin, urethane resin, fluororesin, or the like. The surface of this developing roller 44 may be subjected to surface-smoothing processing or surface-roughening processing according to need.

The developing roller 44 is disposed between the electrophotographic photoreceptor 1 and the feed roller 43, and is in contact with both the electrophotographic photoreceptor 1 and the feed roller 43. The feed roller 43 and the developing roller 44 are rotated by a rotation driving mechanism (not shown). The feed roller 43 holds the toner T stored and supplies the toner T to the developing roller 44. The developing roller 44 holds the toner T supplied by the feed roller 43 and brings the toner T into contact with the surface of the electrophotographic photoreceptor 1.

The control member 45 is constituted of a resinous blade made of a silicone resin, urethane resin, or the like, a metallic blade made of stainless steel, aluminum, copper, brass, phosphor bronze, or the like, a blade obtained by coating such as a metallic blade with a resin, etc. This control member 45 is in contact with the developing roller 44, and is pushed against the developing roller 44 with springs or the like at a given force (the linear blade pressure is generally 5-500 g/cm). According to need, this control member 45 may be made to have the function of charging the toner T by means of electrification caused by friction with the toner T.

The agitators 42 are each rotated by the rotation driving mechanism. The agitators 42 agitate the toner T and convey the toner T to the feed roller 43 side. A plurality of agitators 42 differing in blade shape, size, etc. may be disposed.

The kind of the toner T is not limited, and a polymerization toner or the like obtained by suspension polymerization, emulsion polymerization, etc. can be used besides a powdery toner. Especially when a polymerization toner is used, this toner preferably is one having a small particle diameter of about 4-8 μm. The toner particles to be used can have any of various shapes ranging from a shape close to sphere to a shape which is not spherical, such as a potato shape. Polymerization toners are excellent in terms of evenness of charging and transferability and are suitable for image quality improvement.

The transfer device 5 is not particularly limited in the kind thereof, and use can be made of a device operated by any desired technique selected from an electrostatic transfer technique, pressure transfer technique, adhesive transfer technique, and the like, such as, for example, corona transfer, roller transfer, and belt transfer. Here, the transfer device 5 is a device configured of a transfer charger, transfer roller, transfer belt, or the like disposed so as to face the electrophotographic photoreceptor 1. A given voltage (transfer voltage) which has the polarity opposite to that of the charge potential of the toner T is applied to the transfer device 5, and this transfer device 5 thus serves to transfer the toner image formed on the electrophotographic photoreceptor 1 to recording paper (paper or medium) P.

There are no particular limitations on the cleaner 6, and any desired cleaner can be used, such as a brush cleaner, magnetic brush cleaner, electrostatic brush cleaner, magnetic roller cleaner, or bladed cleaner. The cleaner 6 serves to scrape off the residual toner adherent to the photoreceptor 1 with a cleaning member and thus recover the residual toner. However, when there is little or substantially no toner adherent to the surface of the photoreceptor, the cleaner 6 may be omitted.

The fixing device 7 is configured of an upper fixing member (fixing roller) 71 and a lower fixing member (fixing roller) 72. The fixing member 71 or 72 is equipped with a heater 73 inside. FIG. 1 shows an example in which the upper fixing member 71 is equipped with a heater 73 inside. As each of the upper and lower fixing members 71 and 72, use can be made of a known heat-fixing member such as a fixing roll obtained by coating a metallic tube made of stainless steel, aluminum, or the like with a silicone rubber, a fixing roll obtained by coating the metallic tube with a Teflon resin, or a fixing sheet. Furthermore, the fixing members 71 and 72 may be configured so that a release agent such as a silicone oil is supplied thereto in order to improve release properties, or may be configured so that the two members are forcedly pressed against each other with springs or the like.

The toner which has been transferred to the recording paper P passes through the nip between the upper fixing member 71 heated at a given temperature and the lower fixing member 72, during which the toner is heated to a molten state. After the passing, the toner is cooled and fixed to the recording paper P.

The fixing device also is not particularly limited in the kind thereof. Fixing devices which are operated by any desired fixing technique, such as heated-roller fixing, flash fixing, oven fixing, or pressure fixing, can be disposed besides the fixing device used here.

In the electrophotographic apparatus having the configuration described above, image recording is conducted in the following manner. First, the surface (photosensitive surface) of the photoreceptor 1 is charged to a given potential (e.g., −600 V) by the charging device 2. This charging may be conducted with a direct-current voltage or with a direct-current voltage on which an alternating-current voltage has been superimposed.

Subsequently, the charged photosensitive surface of the photoreceptor 1 is exposed to light by the exposure device 3 in accordance with the image to be recorded. Thus, an electrostatic latent image is formed on the photosensitive surface. This electrostatic latent image formed on the photosensitive surface of the photoreceptor 1 is developed by the developing device 4.

In the developing device 4, toner T fed by the feed roller 43 is spread into a thin layer with the control member (developing blade) 45 and, simultaneously therewith, frictionally charged so as to have given polarity (here, the toner is charged so as to have negative polarity, which is the same as the polarity of the charge potential of the photoreceptor 1). This toner T is conveyed while being held by the developing roller 44 and is brought into contact with the surface of the photoreceptor 1.

When the charged toner T held on the developing roller 44 comes into contact with the surface of the photoreceptor 1, a toner image corresponding to the electrostatic latent image is formed on the photosensitive surface of the photoreceptor 1. This toner image is transferred to recording paper P by the transfer device 5. Thereafter, the toner which has not been transferred and remains on the photosensitive surface of the photoreceptor 1 is removed by the cleaner 6.

After the transfer of the toner image to the recording paper P, this recording paper P is passed through the fixing device 7 to thermally fix the toner image to the recording paper P. Thus, a finished image is obtained.

Incidentally, the image forming apparatus may be configured so that an erase step, for example, can be conducted, besides the configuration described above. The erase step is a step in which the electrophotographic photoreceptor is exposure to light to thereby remove the residual charges from the electrophotographic photoreceptor. As an eraser, use may be made of a fluorescent lamp, LED, or the like. The light to be used in the erase step, in many cases, is light having such an intensity that the exposure energy thereof is at least 3 times that of the exposure light.

The configuration of the image forming apparatus may be further modified. For example, the apparatus may be configured so that steps such as a pre-exposure step and an auxiliary charging step can be conducted therein, or may be configured so that offset printing is conducted therein. Furthermore, the apparatus may have a full-color tandem configuration in which a plurality of toners are used.

Incidentally, the electrophotographic photoreceptor 1 may be combined with one or more of the charging device 2, exposure device 3, developing device 4, transfer device 5, cleaner 6, and fixing device 7 to constitute an integrated cartridge (hereinafter suitably referred to as "electrophotographic photoreceptor cartridge"), and this electrophotographic photoreceptor cartridge may be used in a configuration in which the cartridge can be demounted from the main body of an electrophotographic apparatus, e.g., copier or laser beam printer. In this case, when the electrophotographic photoreceptor 1 or another member has deteriorated, this electrophotographic photoreceptor cartridge is demounted from the main body of the image forming apparatus and a fresh electrophotographic photoreceptor cartridge is mounted on the main body of the image forming apparatus. Thus, maintenance of the image forming apparatus is facilitated.

EXAMPLES

Embodiments of the invention are explained below in more detail by reference to Examples. However, the following Examples are intended only for explaining the invention in detail, and the invention should not be construed as being limited to the following Examples and can be modified at will unless the modifications depart from the spirit of the invention. In the following Examples and Comparative Examples, "parts" means "parts by weight" or "parts by mass" unless otherwise indicated.

Example 1

<Production of Coating Fluid for Undercoat Layer Formation ]

Rutile-form titanium oxide having an average primary-particle diameter of 40 nm ("TTO55N", manufactured by Ishihara Sangyo Kaisha, Ltd.) was mixed with 3% by mass methyldimethoxysilane ("TSL 8117", manufactured by Toshiba Silicone Co., Ltd.), based on the titanium oxide, by means of a Henschel mixer to obtain surface-treated titanium oxide. This surface-treated titanium oxide was dispersed in a methanol/1-propanol mixed solvent, in which the methanol/1-propanol mass ratio was 7/3, with a ball mill to thereby obtain a dispersion slurry of the surface-treated titanium oxide. This dispersion slurry and a methanol/1-propanol/toluene mixed solvent were stirred and mixed, with heating, together with pellets of a copolyamide having a composition in which the ϵ-caprolactam [compound represented by the following formula (A)]/bis(4-amino-3-methylcyclohexyl) methane [compound represented by the following formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] molar ratio was 60%/15%/5%/15%/5%. After the polyamide pellets were dissolved, this mixture was subjected to an ultrasonic dispersion treatment. Thus, a coating fluid for undercoat layer formation which had a methanol/1-propanol/toluene ratio of 7/1/2 by mass, contained the surface-treated titanium oxide and the copolyamide in a mass ratio of 3/1, and had a solid concentration of 18.0% was obtained.

A

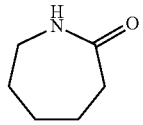

B

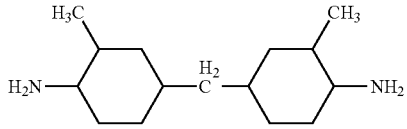

C

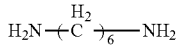

D

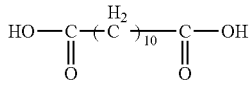

E

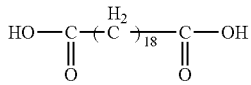

<Production of Coating Fluid for Charge Generation Layer Formation>

First, 20 parts of Y-form (also called D-form) oxytitanium phthalocyanine showing an intense diffraction peak at a Bragg angle (2θ±0.2) of 27.3° in X-ray diffractometry using a CuKα line was mixed, as a charge generation substance, with 280 parts of 1,2-dimethoxyethane. This mixture was subjected to a pulverization/dispersion treatment in which the charge generation substance was pulverized for 1 hour with a grinding sand mill. Subsequently, the resultant fine dispersion was mixed with a binder solution obtained by dissolving 10 parts of poly(vinyl butyral) (trade name "Denka Butyral" #6000C, manufactured by Denki Kagaku Kogyo K.K.) in a liquid mixture composed of 255 parts of 1,2-dimethoxyethane and 85 parts of 4-methoxy-4-methyl-2-pentanone, and with 230 parts of 1,2-dimethoxyethane to prepare a coating fluid for charge generation layer formation.

<Production of Coating Fluid for Charge Transport Layer Formation>

A hundred parts of a polyarylate resin (PE1) having the following repeating structural unit (viscosity-average molecular weight, 40,000), 40 parts of the compound represented by CT1 as a charge transport substance, 5 parts of the compound represented by (2)-7 as an additive, 2 parts of an antioxidant (trade name Irganox 1076, manufactured by Ciba Specialty Chemicals Co.), and 0.05 parts of a silicone oil (trade name KF96, manufactured by Shin-Etsu Silicones) were dissolved in 520 parts of a tetrahydrofuran/toluene (8/2 by mass) mixed solvent to prepare a coating fluid for charge transport layer formation.

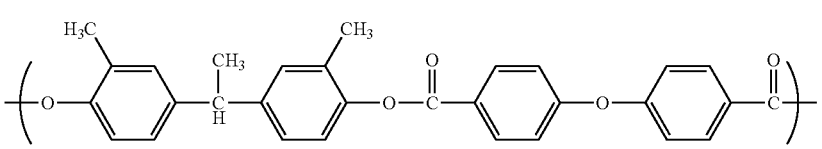

(PE1)

<Production of Photoreceptor>

The coating fluid for undercoat layer formation which had been obtained in the manner described above was applied to a surface of a poly(ethylene terephthalate) sheet having a vapor-deposited aluminum coating on the surface, with a wire-wound bar in such an amount as to result in a film thickness of about 1.3 μm after drying. The coating fluid applied was dried at room temperature to form an undercoat layer.

Subsequently, the coating fluid for charge generation layer formation obtained in the manner described above was applied on the undercoat layer with a wire-wound bar in such an amount as to result in a film thickness of about 0.3 μm after drying. The coating fluid applied was dried at room temperature to form a charge generation layer. The coating fluid for charge transport layer formation obtained in the manner described above was applied on the charge generation layer with an applicator in such an amount as to result in a film thickness of about 25 μm after drying. The coating fluid applied was dried at 125° C. for 20 minutes to produce a photoreceptor. Incidentally, only the photoreceptor samples to be subjected to the measurements of surface hardness and the degree of elastic deformation which will be described later were produced using a glass plate in place of the poly (ethylene terephthalate) sheet as the base.

<Test for Examining Electrical Properties>

An apparatus for electrophotographic-property evaluation produced in accordance with the measurement standards of The Society of Electrophotography of Japan (described in The Society of Electrophotography of Japan, ed., *Zoku Denshi Shashin Gijutsu No Kiso To Ōyō*, Corona Publishing Co., Ltd., pp. 404-405) was used. The sheet-shaped photoreceptor was wound around the aluminum cylinder having a diameter of 80 mm and grounded. This photoreceptor was charged to an initial surface potential of about −700 V. The light from the halogen lamp was converted to 780-nm monochromatic light with an interference filter and used to determine both the exposure amount which caused the surface potential to become ½ the initial surface potential (half-decay exposure amount; unit, $\mu J/cm^2$; referred to as $E_{1/2}$) and the surface potential which resulted from exposure of 0.6 $\mu J/cm^2$ (exposed-area potential; referred to as VL). The time period from the exposure to the potential measurement was set at 100 ms. The measurement was made in an atmosphere of 25° C. and 50% RH. Large absolute values of VL indicate that the photoreceptors have poor responsiveness to the exposure. The results thereof are shown in Table 1.

<Measurement of Surface Hardness of Photoreceptor>

The universal hardness of the photoreceptor surface was measured with microhardness meter FISCHERSCOPE HM2000, manufactured by Fischer (HM2000 is the successor to H100C, manufactured by the same company, and is equal thereto in performance), in an atmosphere having a temperature of 25° C. and a relative humidity of 50%. The universal hardness was determined through the measurement in which the indenter was forced into the specimen until the indentation load became 5 mN, and was expressed in terms of the value defined by the following equation from the indentation depth measured under that load. In the measurement made in this range, the influence of the base can be excluded.

Universal hardness ($N/mm^2$)=[test load (N)]/[surface area of the portion of Vickers indenter which penetrated under the test load ($mm^2$)]

<Measurement of Degree of Elastic Deformation of Photoreceptor>

The degree of elastic deformation of the photoreceptor was measured with microhardness meter FISCHERSCOPE HM2000, manufactured by Fischer (HM2000 is the successor to H100C and is equal thereto in performance), in an atmosphere having a temperature of 25° C. and a relative humidity of 50%. For the measurement is used a Vickers square-based diamond pyramid indenter in which the angle between nonadjacent faces is 136°. The measurement was conducted under the conditions shown below, and the load being imposed on the indenter and the indentation depth under the load were continuously read and plotted as Y-axis and X-axis, respectively, thereby acquiring a profile such as that shown in FIG. 2.

Measurement Conditions

Maximum indentation load, 5 mN

Load-increasing period, 10 sec

Load-removing period, 10 sec

The degree of elastic deformation is the value defined by the following equation, and is the proportion of the amount of the work which the film performs by means of the elasticity thereof during the load removal to the total amount of the work required for the indentation.

$$\text{Degree of elastic deformation}(\%)=(We/Wt)\times 100$$

Figure 2:
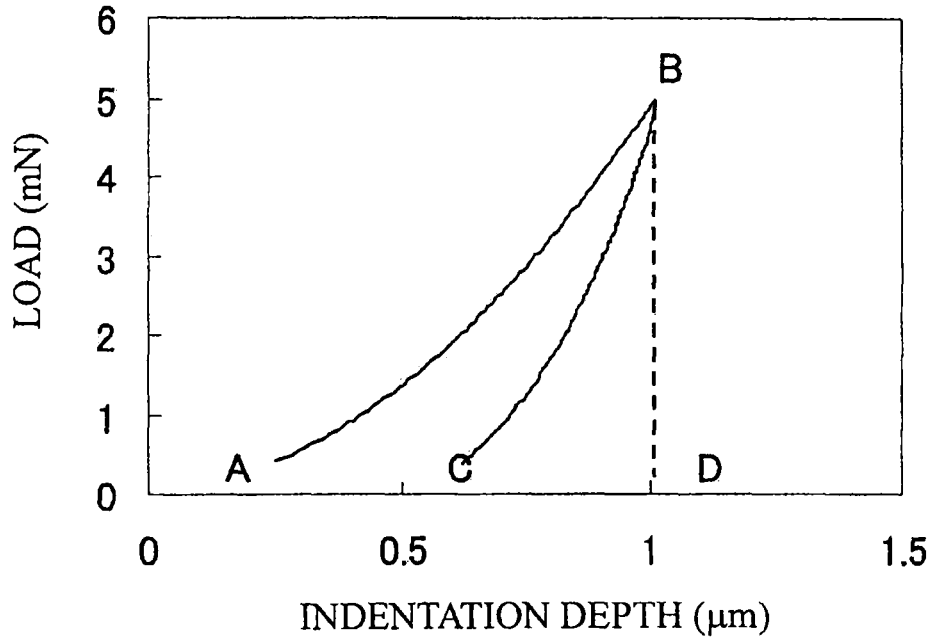
FIG. 2 is a diagrammatic presentation which illustrates a method for calculating the universal hardness and degree of elastic deformation of a photoreceptor, by means of a graph that shows a curve showing a relationship between indentation depth and load in the photoreceptor.

In the equation, the total amount of work, Wt (nJ), indicates the area surrounded by A-B-D-A in FIG. 2, and the amount of the work made by the elastic deformation, We (nJ), indicates the area surrounded by C-B-D-C. The higher the degree of elastic deformation, the less the deformation caused by load remains. The case where the degree of elastic deformation is 100 means that no deformation remains.

<Tabor Abrasion Test>

A Tabor abrasion test of the photoreceptor was conducted in the following manner. A disk having a diameter of 10 cm was cut out of the photoreceptor film and set in a Tabor abrasion tester (manufactured by Toyo Seiki Seisaku-Sho).

The specimen was tested under the conditions of an atmosphere of 23° C. and 50% RH using abrasion wheels CS-10F under a load of 500 g (load of 500 g was imposed besides the own weight of each abrasion wheel). After the specimen was rotated to make 1,000 turns, the resultant abrasion loss was determined by measuring the loss in mass which had occurred through the test. The results obtained are shown in Table 1. The smaller the abrasion loss, the better the wear resistance.

Example 2

A photoreceptor was produced and evaluated in the same manners as in Example 1, except that the compound (2)-7 was replaced with (3)-2. The results obtained are shown in Table 1.

Example 3

A photoreceptor was produced and evaluated in the same manners as in Example 1, except that the compound (2)-7 was replaced with (4)-4. The results obtained are shown in Table 1.

Comparative Example 1

A photoreceptor was produced and evaluated in the same manners as in Example 1, except that the compound (2)-7 was omitted. The results obtained are shown in Table 1.

Examples 4 to 6 and Comparative Example 2

Photoreceptors were produced and evaluated in the same manners as in Examples 1 to 3 and Comparative Example 1, except that the charge transport substance CT1 was replaced with CT8. The results obtained are shown in Table 1.

Examples 7 to 9 and Comparative Example 3

Photoreceptors were produced and evaluated in the same manners as in Examples 1 to 3 and Comparative Example 1, except that the binder resin PE1 was replaced with a polycarbonate resin PC1 composed of the following structural unit (viscosity-average molecular weight, 40,000). The results obtained are shown in Table (PC1)

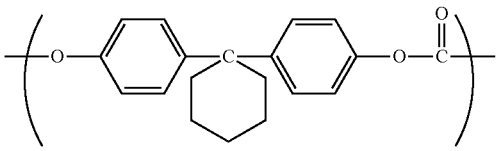

Example 10

A photoreceptor was produced and evaluated in the same manners as in Example 1, except that the binder resin PE1 was replaced with a polyarylate resin PE2 composed of the following structural unit (viscosity-average molecular weight, 35,000; terephthalic acid/isophthalic acid=50/50). The results obtained are shown in Table 1.

(PE2)

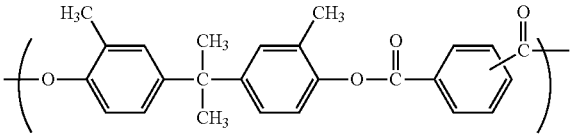

Example 11

A photoreceptor was produced and evaluated in the same manners as in Example 1, except that the binder resin PE1 was replaced with a polyarylate resin PE3 composed of the following structural unit (viscosity-average molecular weight, 30,000; terephthalic acid/isophthalic acid=50/50). The results obtained are shown in Table 1.

(PE3)

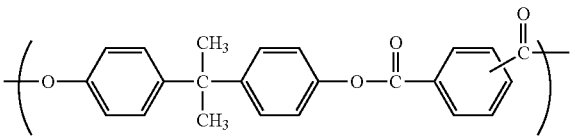

Example 12

A photoreceptor was produced and evaluated in the same manners as in Example 1, except that the binder resin PE1 was replaced with a polycarbonate resin PC2 represented by the following structural formula (viscosity-average molecular weight, 50,000; m:n=60:40). The results obtained are shown in Table 1.

(PC2)

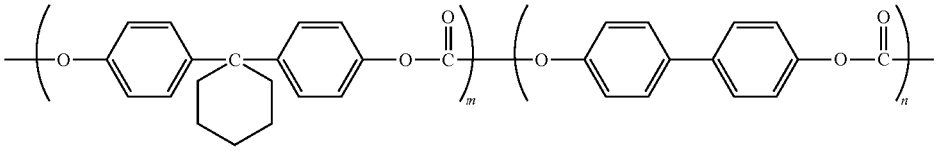

Example 13

A photoreceptor was produced and evaluated in the same manners as in Example 1, except that the binder resin PE1 was replaced with a polyester resin PE4 (Mv=21,000; a:b:c:d=1:1:1:1). The results obtained are shown in Table 1.

(PE4)

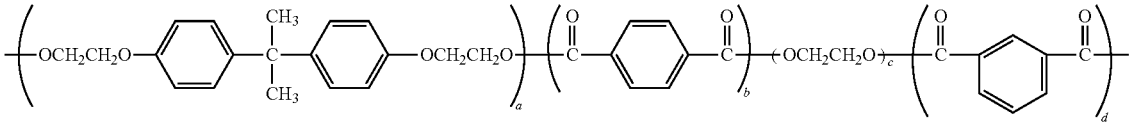

Comparative Example 4

A photoreceptor was produced and evaluated in the same manners as in Example 1, except that the charge transport substance CT1 was replaced with CTA, which was represented by the following structural formula. The results obtained as shown in Table 1.

(CTA)

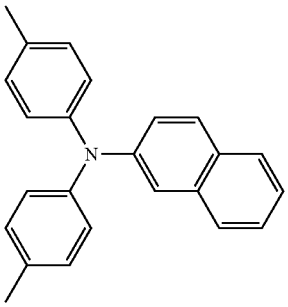

Comparative Example 5

A photoreceptor was produced and evaluated in the same manners as in Example 1, except that the charge transport substance CT1 was replaced with CTB, which was represented by the following structural formula. The results obtained as shown in Table 1.

(CTB)

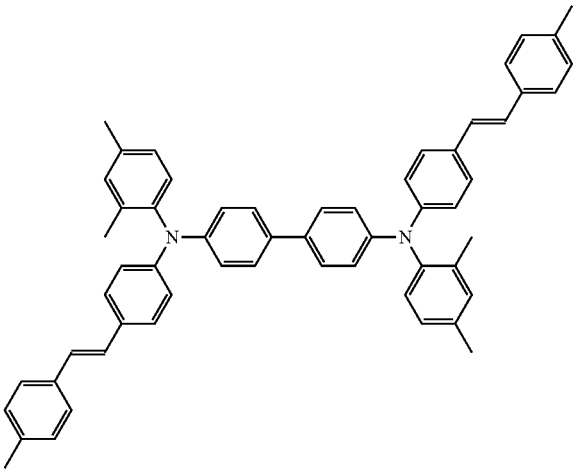

Reference Example 1

A photoreceptor was produced and evaluated in the same manners as in Comparative Example 5, except that the compound (2)-7 was omitted. The results obtained are shown in Table 1.

Comparative Example 6

A photoreceptor was produced and evaluated in the same manners as in Example 1, except that the charge transport substance CT1 was replaced with CTC, which was represented by the following structural formula. The results obtained as shown in Table 1.

(CTC)

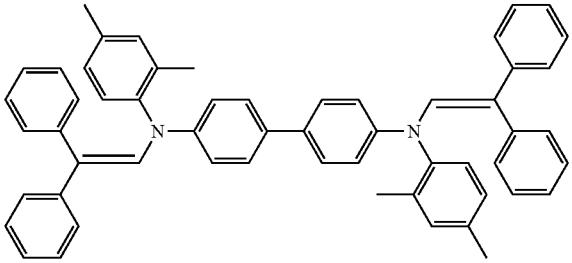

Reference Example 2

A photoreceptor was produced and evaluated in the same manners as in Comparative Example 6, except that the compound (2)-7 was omitted. The results obtained are shown in Table 1.

Examples 14 to 18

Photoreceptors were produced and evaluated in the same manners as in Example 1, except that the amount of compound (2)-7 was changed as shown in Table 1. The results obtained are shown in Table 1.

Comparative Example 7

A photoreceptor was produced and evaluated in the same manners as in Example 1, except that the compound (2)-7 was replaced with the following CTD and that the addition amount was changed to 20 parts. The results obtained are shown in Table 1.

(CTD)

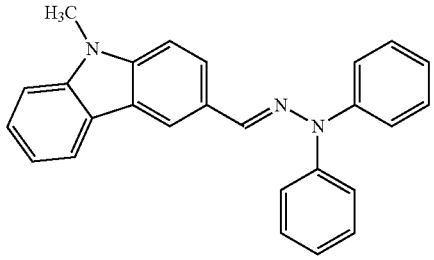

Comparative Example 8

A photoreceptor was produced and evaluated in the same manners as in Example 1, except that the compound (2)-7 was replaced with the following AD1. The results obtained are shown in Table 1.

(AD1)

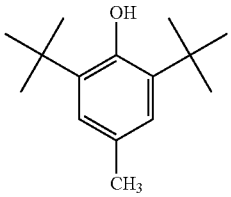

Comparative Example 9

A photoreceptor was produced and evaluated in the same manners as in Example 1, except that the compound (2)-7 was replaced with the following AD2. As a result, the AD2 precipitated in the photosensitive layer, making it impossible to conduct evaluation.

(AD2)

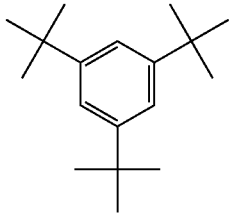

Comparative Example 10

A photoreceptor was produced and evaluated in the same manners as in Example 1, except that the compound (2)-7 was replaced with the following AD3. The results obtained are shown in Table 1.

(AD3)

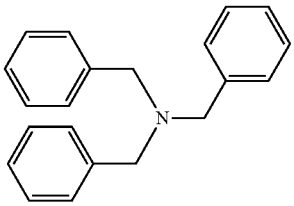

TABLE 1

| | Charge transport substance (1) | Binder resin | Additive [parts] | $E_{1/2}$ ($\mu J/cm^2$) | VL (−V) | Universal hardness ($N/mm^2$) | Degree of elastic deformation (%) | Tabor abrasion test |
|---|---|---|---|---|---|---|---|---|
| Example 1 | CT1 | PE1 | (2)-7[5] | 0.110 | 19 | 145 | 41.3 | 1.5 |
| Example 2 | CT1 | PE1 | (3)-2[5] | 0.111 | 19 | 144 | 41.7 | 1.3 |
| Example 3 | CT1 | PE1 | (4)-4[5] | 0.108 | 20 | 146 | 41.8 | 1.2 |
| Comparative Example 1 | CT1 | PE1 | — | 0.107 | 19 | 132 | 41.5 | 2.3 |
| Example 4 | CT8 | PE1 | (2)-7[5] | 0.109 | 17 | 141 | 41.4 | 1.8 |
| Example 5 | CT8 | PE1 | (3)-2[5] | 0.112 | 18 | 141 | 41.8 | 1.7 |
| Example 6 | CT8 | PE1 | (4)-4[5] | 0.111 | 18 | 143 | 42.1 | 1.8 |
| Comparative Example 2 | CT8 | PE1 | — | 0.109 | 18 | 130 | 41.6 | 2.5 |
| Example 7 | CT8 | PC1 | (2)-7[5] | 0.101 | 11 | 155 | 37.5 | 4.0 |
| Example 8 | CT8 | PC1 | (3)-2[5] | 0.101 | 12 | 152 | 38.7 | 3.6 |
| Example 9 | CT8 | PC1 | (4)-4[5] | 0.099 | 11 | 157 | 38.9 | 3.8 |
| Comparative Example 3 | CT8 | PC1 | — | 0.100 | 11 | 141 | 38.0 | 5.9 |
| Example 10 | CT1 | PE2 | (2)-7[5] | 0.117 | 25 | 143 | 40.2 | 3.1 |
| Example 11 | CT1 | PE3 | (2)-7[5] | 0.125 | 31 | 138 | 37.0 | 3.9 |
| Example 12 | CT1 | PC2 | (2)-7[5] | 0.103 | 13 | 147 | 39.1 | 3.8 |
| Example 13 | CT1 | PE4 | (2)-7[5] | 0.120 | 38 | 137 | 34.5 | 7.8 |
| Comparative Example 4 | CTA | PE1 | (2)-7[5] | 0.132 | 220 | 225 | 44.0 | 1.6 |
| Comparative Example 5 | CTB | PE1 | (2)-7[5] | 0.119 | 58 | 161 | 45.7 | 1.7 |
| Reference Example 1 | CTB | PE1 | — | 0.117 | 57 | 154 | 46.7 | 2.2 |
| Comparative Example 6 | CTC | PE1 | (2)-7[5] | 0.112 | 49 | 183 | 43.7 | 1.9 |
| Reference Example 2 | CTC | PE1 | — | 0.109 | 47 | 176 | 44.1 | 2.4 |
| Example 14 | CT8 | PE1 | (2)-7[1] | 0.108 | 18 | 137 | 41.6 | 2.1 |
| Example 15 | CT8 | PE1 | (2)-7[10] | 0.110 | 17 | 150 | 41.9 | 2.3 |
| Example 16 | CT8 | PE1 | (2)-7[15] | 0.112 | 19 | 153 | 41.1 | 2.5 |
| Example 17 | CT8 | PE1 | (2)-7[20] | 0.118 | 23 | 155 | 40.3 | 2.4 |
| Example 18 | CT8 | PE1 | (2)-7[30] | 0.125 | 28 | 157 | 38.3 | 3.8 |
| Comparative Example 7 | CT8 | PE1 | CTD[20] | 0.112 | 19 | 160 | 39.4 | 5.0 |
| Comparative Example 8 | CT8 | PE1 | AD1[5] | 0.128 | 37 | 130 | 40.8 | 1.7 |
| Comparative Example 9 | CT8 | PE1 | AD2[5] | unable to be measured due to precipitation | | | | |
| Comparative Example 10 | CT8 | PE1 | AD3[5] | 0.134 | 57 | 132 | 40.5 | 1.8 |

As can be seen from Table 1, the charge transport substances represented by formula (1) according to the invention improved the surface hardness and wear resistance without impairing the other performances, in cases when any of compounds represented by formulae (2), (3), and (4) was contained. Meanwhile, charge transport substances having a small conjugated system, like the charge transport substance of Comparative Example 4, bring about considerably impaired electrical properties when used in the same amount. The charge transport substances of Comparative Examples 5 and 6, which are described in patent document 5, are also insufficient in electrical property as compared with the charge transport substances specified in the invention, and are unusable in applications where a lower VL is required. Furthermore, in the case where a second charge transport substance having a low molecular weight is also used additionally as described in patent document 6, the wear resistance is impaired (Comparative Example 7). The compound shown in Comparative Example 8 (AD1), even when incorporated, brings about no change in surface hardness, and does not have the function of filling the free volume of the photosensitive layer. The compound shown in Comparative Example 9 (AD2) undesirably aggregates and crystallizes by itself and shows no improving effect. The compound shown in Comparative Example 10 (AD3) is low in the function of filling free volume and impairs the electrical properties.

Example 19

Production of Photoreceptor Drum

The coating fluid for charge generation layer formation and coating fluid for charge transport layer formation which had been used for producing the photoreceptor of Example 4 were successively applied to and dried on an aluminum cylinder which had an outer diameter of 30 mm, length of 246 mm, and wall thickness of 0.75 mm and in which the surface had been roughly machine-finished, anodized, and cleaned. A charge generation layer and a charge transport layer were thereby formed so that these layers, after drying, had thicknesses of 0.4 μm and 18 μm, respectively. Thus, a photoreceptor drum was produced. The drying of the charge transport layer was conducted at 130° C. for 20 minutes.

<Image Test>

The photoreceptor obtained was mounted on the photoreceptor cartridge of full-color tandem printer C711dm, manufactured by Oki Data Corp. (DC roller charging; LED exposure; contact type nonmagnetic one-component development). In an atmosphere having a temperature of 10° C. and a relative humidity of 15%, continuous printing was conducted on 12,500 sheets at a coverage rate of 5%. As a result, none of ghost images, fogging, decrease in density, and image failures due to filming, cleaning failures, scratches, etc. occurred, and satisfactory images were obtained.

Examples 20 to 26, Comparative Examples 11 to 17, and Reference Examples 3 and 4

Photoreceptor drums were produced and subjected to an image test in the same manners as in Example 19, except that the photosensitive layer of Example 19 was replaced with the photosensitive layers shown in Table 2. The results obtained are shown in Table 2.

TABLE 2

| | Photosensitive layer in Table 1 | Charge transport substance (1) | Binder resin | Additive [parts] | Filming | Scratch | Other image defects | Noise | Film peeling |
|---|---|---|---|---|---|---|---|---|---|
| Example 19 | Example 4 | CT8 | PE1 | (2)-7[5] | A | B | | B | B |
| Example 20 | Example 5 | CT8 | PE1 | (3)-2[5] | B | B | | B | B |
| Example 21 | Example 6 | CT8 | PE1 | (4)-4[5] | B | B | | B | B |
| Comparative Example 11 | Comparative Example 2 | CT8 | PE1 | — | D | D | | D | D |
| Example 22 | Example 7 | CT8 | PC1 | (2)-7[5] | C | C | | B | A |
| Example 23 | Example 8 | CT8 | PC1 | (3)-2[5] | C | C | | B | A |
| Example 24 | Example 9 | CT8 | PC1 | (4)-4[5] | C | C | | B | A |
| Comparative Example 12 | Comparative Example 3 | CT8 | PC1 | — | D | D | cleaning failure | D | C |
| Example 25 | Example 10 | CT1 | PE2 | (2)-7[5] | B | C | | B | C |
| Example 26 | Example 12 | CT1 | PC2 | (2)-7[5] | B | B | | B | D |
| Comparative Example 13 | Comparative Example 5 | CTB | PE1 | (2)-7[5] | B | B | low image density | B | C |
| Reference Example 3 | Reference Example 1 | CTB | PE1 | — | B | B | low image density | B | C |
| Comparative Example 14 | Comparative Example 6 | CTC | PE1 | (2)-7[5] | A | B | low image density | B | D |
| Reference Example 4 | Reference Example 2 | CTC | PE1 | — | A | B | low image density | B | D |
| Comparative Example 15 | Comparative Example 7 | CT8 | PE1 | CTD[20] | C | D | fogging due to impaired wear resistance | A | B |
| Comparative Example 16 | Comparative Example 8 | CT8 | PE1 | AD1[5] | D | D | cleaning failure | D | C |
| Comparative Example 17 | Comparative Example 10 | CT8 | PE1 | AD3[5] | C | C | low image density | B | C |

A: excellent (not occurred)
B: good
C: insufficient but allowable
D: NG (occurred)

As can be seen from Table 2, the charge transport substances represented by formula (1) according to the invention were effective in preventing the occurrence of image defects due to filming or scratches and posed no problem concerning noise or film peeling, in cases when the compound having a specific structure was contained. Furthermore, the Examples according to the invention gave results in which no film peeling had occurred and the adhesion had been high. In contrast, in Comparative Examples 11 and 12, in which none of the compounds represented by formulae (2), (3), and (4) was contained, not only filming and scratches but also streak image defects due to cleaning failures were observed and the photoreceptors had deteriorated also in noise and film peeling. In Comparative Examples 13 and 14, not only the image density was insufficient due to a deterioration in electrical property but also film peeling was observed. Incidentally, the addition of compound (2)-7 in Comparative Examples 13 and 14 produced no effect as can be seen from Reference Examples 3 and 4. In Comparative Example 15, the photosensitive layer showed a large abrasion loss and, in the last stage of the life, scratches occurred considerably and fogging due to the decrease in film thickness also occurred. In Comparative Examples 16 and 17, the incorporation of AD 1 and AD3 produced substantially no improving effect.

This application is based on Japanese patent application JP 2013-169630, filed on Aug. 19, 2013, the entire content of which is hereby incorporated by reference, the same as if set forth at length.

DESCRIPTION OF THE REFERENCE NUMERALS AND SIGNS

1 Photoreceptor (electrophotographic photoreceptor)
2 Charging device (charging roller; charging part)
3 Exposure device (exposure part)
4 Developing device (developing part)
5 Transfer device
6 Cleaner
7 Fixing device
41 Developing vessel
42 Agitator
43 Feed roller
44 Developing roller
45 Control member
71 Upper fixing member (fixing roller)
72 Lower fixing member (fixing roller)
73 Heater
T Toner
P Recording paper (paper, medium)

What is claimed is:

1. An electrophotographic photoreceptor comprising a conductive support and a photosensitive layer provided thereon, wherein the electrophotographic photoreceptor comprises an outermost layer which contains a charge transport substance represented by the following formula (1) and a compound represented by the following formula (5):

Formula (1)

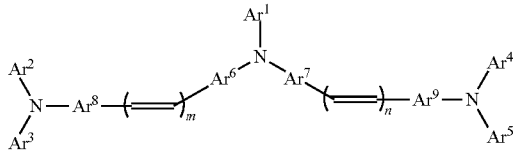

wherein $Ar^1$ to $Ar^5$ each independently represent an aryl group which may have a substituent, $Ar^6$ to $Ar^9$ each is a 1,4-phenylene group which may have a substituent, and m and n each independently represent an integer of 1 to 3;

Formula (5)

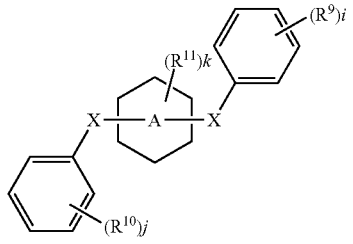

wherein $R^9$ to $R^{11}$ each independently represent an alkyl group, A represents a cyclohexane ring or benzene ring, X represents a single bond, —$CH_2$—, or —$CH_2OCO$—, and i to k each independently represent an integer of 0 to 3.

2. The electrophotographic photoreceptor according to claim 1, wherein the photosensitive layer includes, as a binder resin, a polycarbonate resin which has a structural unit represented by the following formula (7):

Formula (7)

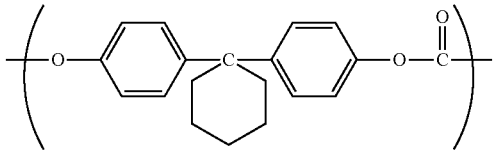

3. The electrophotographic photoreceptor according to claim 1, wherein the photosensitive layer includes, as a binder resin, a polyester resin represented by the following formula (6):

Formula (6)

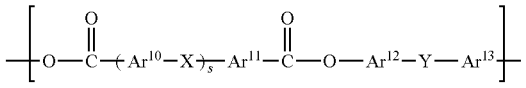

wherein $Ar^{10}$ to $Ar^{13}$ each independently represent an arylene group which may have a substituent, X represents a single bond, an oxygen atom, a sulfur atom, or an alkylene group, s represents an integer of 0 to 2, and Y represents a single bond, an oxygen atom, a sulfur atom, or an alkylene group.

4. The electrophotographic photoreceptor according to claim 1, wherein the outermost layer contains the compound represented by formula (5) in an amount of 1 to 20 parts by mass per 100 parts by mass of a binder resin of the outermost layer.

5. The electrophotographic photoreceptor according to claim 1, wherein the compound represented by formula (5) is any of compounds represented by the following formulae (2), (3), and (4):

Formula (2)

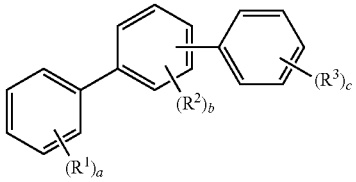

wherein $R^1$ to $R^3$ each independently represent an alkyl group, and a, b, and c each independently represent an integer of 0 to 3;

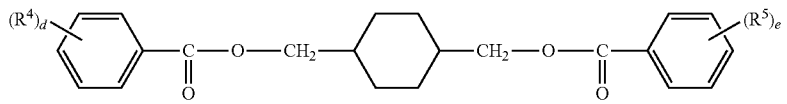

wherein $R^4$ and $R^5$ each independently represent an alkyl group, and d and e each independently represent an integer of 0 to 3;

Formula (4)

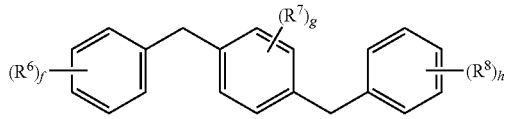

wherein $R^6$ to $R^8$ each independently represent an alkyl group, and f, g, and h each independently represent an integer of 0 to 3.

6. The electrophotographic photoreceptor according to claim 1, wherein in formula (1), $Ar^1$ to $Ar^5$ each independently represent a phenyl group which may have an alkyl group or alkoxy group, $Ar^6$ to $Ar^9$ each independently represent a 1,4-phenylene group which may have a substituent, and m and n are 1.

7. An electrophotographic photoreceptor cartridge comprising: the electrophotographic photoreceptor according to claim 1; and at least one selected from the group consisting of a charging device for charging the electrophotographic photoreceptor, an exposure device for exposing the charged electrophotographic photoreceptor to form an electrostatic latent image, and a developing device for developing the electrostatic latent image formed on the electrophotographic photoreceptor.

8. An image forming apparatus comprising: the electrophotographic photoreceptor according to claim 1; a charging device for charging the electrophotographic photoreceptor; an exposure device for exposing the charged electrophotographic photoreceptor to form an electrostatic latent image; and a developing device for developing the electrostatic latent image formed on the electrophotographic photoreceptor.

* * * * *